US005445924A

United States Patent [19]

Kawai

[11] Patent Number: 5,445,924

[45] Date of Patent: Aug. 29, 1995

[54] LASER COLOR IMAGING METHOD USING A CYAN DYE COUPLER

[75] Inventor: Kiyoshi Kawai, Minami-ashigara, Japan

[73] Assignee: Fuji Photo Film Co., Ltd., Kanagawa, Japan

[21] Appl. No.: 19,905

[22] Filed: Feb. 19, 1993

[30] Foreign Application Priority Data

Feb. 21, 1992 [JP] Japan ..... 4-072711

[51] Int. Cl.[6] ..... G03C 1/035; G03C 1/40; G03C 7/36; G03C 7/384

[52] U.S. Cl. ..... 430/363; 430/384; 430/385; 430/558; 430/388; 430/389; 430/944; 430/945; 430/963

[58] Field of Search ..... 430/363, 385, 558 R, 430/944, 945, 963, 384

[56] References Cited

U.S. PATENT DOCUMENTS

| | | | |
|---|---|---|---|
| 4,873,183 | 10/1989 | Tachibana et al. | 430/385 |
| 4,910,127 | 3/1990 | Sakai et al. | 430/546 |
| 5,057,405 | 10/1991 | Shiba et al. | 430/944 |
| 5,256,526 | 10/1993 | Suzuki et al. | 430/558 |
| 5,270,153 | 12/1993 | Suzuki et al. | 430/385 |

FOREIGN PATENT DOCUMENTS

| | | |
|---|---|---|
| 0488248 | 6/1992 | European Pat. Off. . |
| WO8704534 | 7/1987 | WIPO . |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

There is disclosed a method for forming a color image using a silver halide color photographic material having three silver halide photosensitive layers on a support, comprising, in a cyan color-forming coupler-containing photosensitive layer, a cyan dye-forming coupler represented by formula (I) or (II), wherein said photographic material is exposed by a scanning exposure system and then is subjected to color development processing:

formula(I)

formula(II)

wherein Za and Zb each represent —C($R_3$)= or —N=, provided that one of Za and Zb represents —N= and the other represents —C($R_3$)=; $R_1$ and $R_2$ each represent an electron-attracting group; $R_3$ represents a hydrogen atom or a substituent; and X represents a hydrogen atom or a coupling-off group, provided that $R_1$, $R_2$, $R_3$, or X may be a divalent group, to form a dimer or higher polymer, or to bond to a polymer chain to form a homopolymer or copolymer.

20 Claims, 2 Drawing Sheets

LASER COLOR IMAGING METHOD USING A CYAN DYE COUPLER

FIELD OF THE INVENTION

The present invention relates to a method for forming a high image quality color image by scanning exposure using high-density light (high-intensity light), for example from a laser or a light-emitting diode, and to a silver halide photographic material which can be used in the method and enables to rapidly provide the high image quality color image.

BACKGROUND OF THE INVENTION

In recent years, techniques for converting image information into electrical signals to be transmitted or stored or to be reproduced on a CRT have been developed highly. Along with this, a demand for hard copies from that image information has increased, and various means of obtaining hard copies have been suggested. However, many of these hard copies are poor in image quality, and in particular the image quality of all color hard copies is not comparable with that of prints using current color papers. As means of providing a hard copy having high image quality, for example, Pictrography (trade name) that is manufactured by Fuji Photo Film Co., Ltd. and uses an LED scanning exposure system as a system for the thermal development dye diffusion of a silver halide, can be mentioned.

On the other hand, due to the progress made in silver halide photographic materials and compact simple rapid-development systems (e.g., mini-lab systems), quite high image-quality printed photographs are supplied relatively easily and inexpensively in a short period of time. Therefore, there is very high demand for a hard copy material that can form high image quality as a hard copy of image information, that is inexpensive for such use; can be processed simply and rapidly; and that can give stable performance.

In general, the method of obtaining a hard copy from electrical signals takes a scanning exposure system wherein generally pieces of image information are successively picked up and exposed, and accordingly a photographic material suitable therefore is required. When a hard copy is to be obtained rapidly using a silver halide photographic material, it is required to shorten both the time of scanning exposure and the time of the development processing step. To shorten the time of scanning exposure, the exposure time per picture element has to be shortened as much as possible by using a light source high in output. However, with respect to silver halide emulsion grains, it is well known that the exposure intensity becomes higher and the exposure time becomes shorter, development activity of the latent image formed by the exposure becomes weaker, and the developing speed becomes slower, and the change of the photographic properties due to a change in the processing solution becomes greater. Further, in order to make the development processing step simple and rapid, it is required to use a silver halide emulsion having a high silver chloride content, as described in WO 87-04534. However, the use of this silver halide emulsion having a high silver chloride content results in a further increase in the change of the photographic properties due to a change in the processing solution with short, high-intensity exposure, in comparison with silver bromide emulsions and silver bromochloride emulsions that have a low silver chloride content. In addition, if the time of the development processing step is shortened further, the change of the photographic properties due to a change in the processing solution increases further. As a result, in order to obtain a hard copy simply and rapidly with the performance constant at all times, a technique is required wherein the latent image formed from a silver halide emulsion having a high silver chloride content with high-intensity and short-time exposure is developed stably in as short a time period as possible.

As a light source for exposure of scanning exposure system recording apparatuses, for example, a glow lamp, a xenon lamp, a mercury lamp, a tungsten lamp, or a light-emitting diode is used conventionally. However, any of these light sources is attended with such practical defects as that the output is weak and the life is short. To circumvent these defects, there is a scanner that uses as a light source for a scanning system a coherent laser light source, for example a semiconductor laser or a gas laser, such as a He—Ne laser, an argon laser, and a He—Cd laser.

Gas lasers can give high output, but they are attended with such defects as that they are large in size and expensive and require a modulator.

On the other hand, semiconductor lasers have such good points as that they are small in size and inexpensive; they can be modulated easily; and they have a longer life than gas lasers. The luminescence wavelength of these semiconductor lasers lies mainly in the range from the red region to the infrared region. When the semiconductor laser is used as a light source, the semiconductor laser may be used in two ways. One way combines a semiconductor laser with a non-linear optical element to take out the visible secondary higher harmonics, so that a silver halide photographic material sensitized spectrally to visible radiation may be exposed to the light; the other way uses a semiconductor laser that can emit light ranging from red light to infrared light, so that a silver halide photographic material highly sensitive to the red/infrared region may be exposed to the light.

However, the conventional red/infrared-sensitive photographic material is unstable in latent image after exposure to light, and it is high in the change of photographic properties due to a change in the development processing, in comparison with photographic materials spectrally sensitized for blue/green. Further, in high-intensity exposure using a laser, the change of photographic properties due to a change in the development processing is increased further, and the change is far from practical application.

SUMMARY OF THE INVENTION

Therefore, an object of the present invention is to provide a method for forming a high image quality color image by scanning exposure using a high-intensity light.

Another object of the present invention is to provide a method for rapidly and inexpensively provide by scanning exposure a hard copy having high image quality which material is improved in the change of photographic properties due to a change of development processing.

A further object of the present invention is to provide a silver halide photographic material which can be used in the method for forming the high image quality and enables to rapidly and inexpensively provide the hard copy having high image quality.

Other and further objects, features, and advantages of the invention will appear more fully from the following description taken in connection with the accompanying drawings.

DETAILED DESCRIPTION OF THE INVENTION

Figure 1:
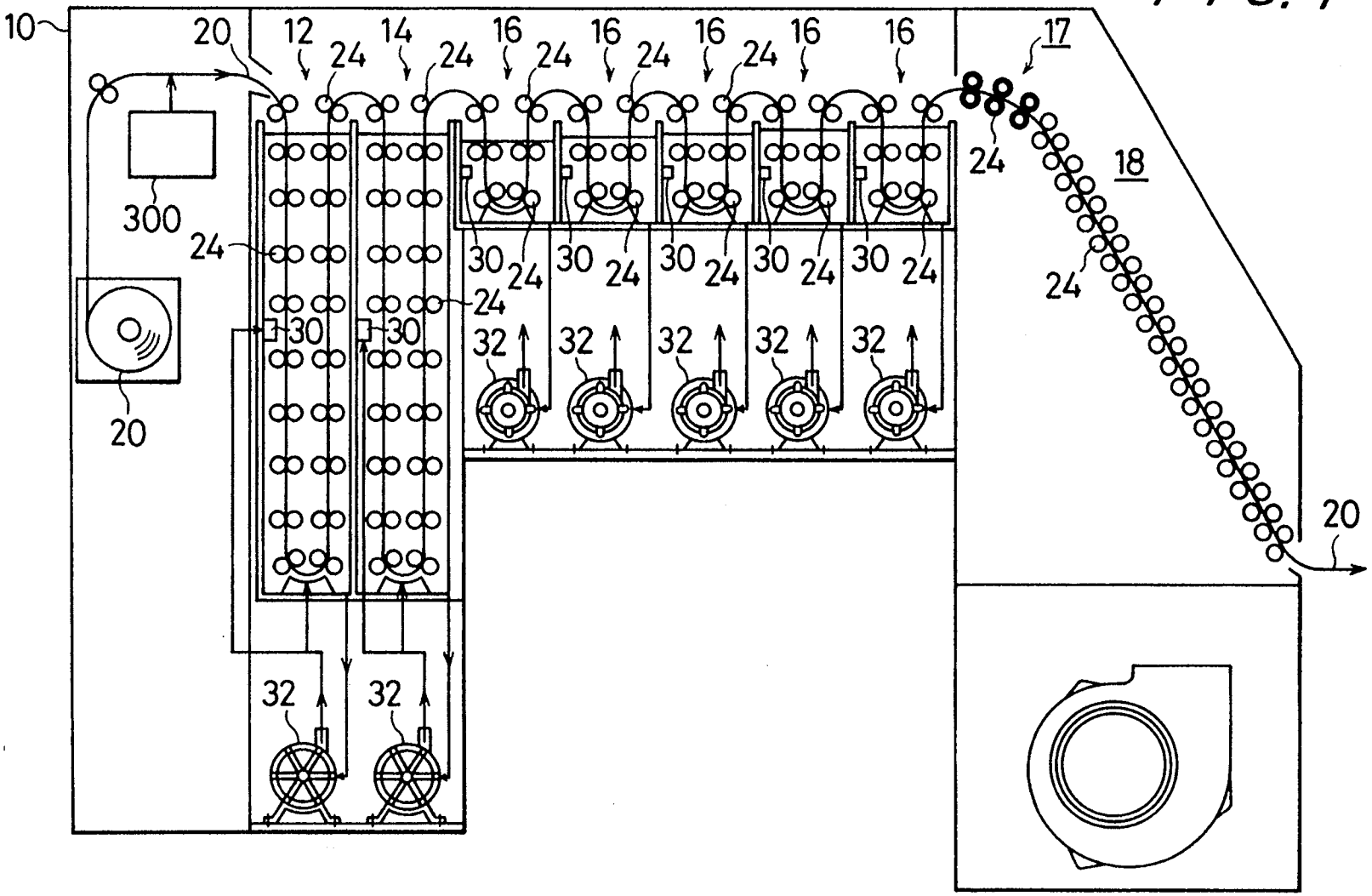
FIG. 1 is a schematic diagram of the structure of an image-forming apparatus suitable to perform the method for forming a color image of the present invention.

The above object of the present invention is attained by a method for forming a color image using a silver halide color photographic material having on a support at least three silver halide photosensitive layers that are different in color sensitivity and that contain respectively a coupler capable of forming a color of yellow, magenta, or cyan, comprising, in at least one photosensitive layer containing a cyan color-forming coupler of the said silver halide color photographic material, at least one cyan dye-forming coupler represented by the following formula (I) or (II) wherein said photographic material is exposed to light by a scanning exposure system wherein the exposure time per picture element is less than $10^{-4}$ sec, and then is subjected to color development processing.

formula(I)

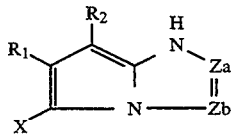

formula(II)

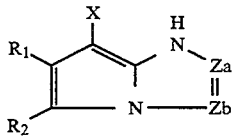

Za and Zb in formulae (I) and (II) each represent —C($R_3$)= or —N=, provided that one of Za and Zb represents —N= and the other represents —C($R_3$)=. $R_1$ and $R_2$ each represent an electron-attracting group, wherein the Hammett substituent constant $\sigma_p$ value is 0.20 or over, with the sum of the $\sigma_p$ values of $R_1$ and $R_2$ being 0.65 or over. $R_3$ represents a hydrogen atom or a substituent. X represents a hydrogen atom or a group capable of being released upon coupling reaction with the oxidized product of an aromatic primary amine color-developing agent (a coupling-off group). $R_1$, $R_2$, $R_3$, or X may be a divalent group, to form a dimer or higher polymer, or to bond to a polymer chain to form a homopolymer or copolymer.

The object of the present invention can be attained effectively by allowing at least one layer of said cyan color-forming coupler-containing photosensitive layers to contain silver halide emulsion grains having a silver chloride content of 95 mol % or more.

Further, the object of the present invention is more effectively attained in a method for forming a color image wherein the spectral sensitivity maximum of the silver halide photosensitive layer containing a cyan dye-forming coupler represented by formula (I) or (II) is 560 nm or over and a laser is used as a scanning exposure light source; or in a method for forming a color image wherein all the spectral sensitivity maximums of the three silver halide photosensitive layers different in sensitivity are 650 nm or over, and a semiconductor laser is used as a scanning exposure light source.

Preferably, in the above method for forming a color image, the color development processing time is 25 sec or below, and the total processing time from said color developing process to drying process both inclusive is 120 sec or below.

Hereinbelow, the present invention will be described in detail.

First, the compounds of formulae (I) or (II) will be described.

Specifically, the cyan couplers of the present invention are represented by the following formulae (I-a), (I-b), (II-a), and (II-b):

formula (I-a)

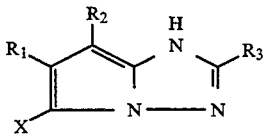

formula (II-a)

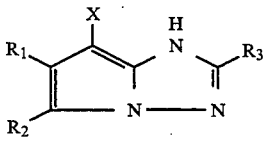

formula (I-b)

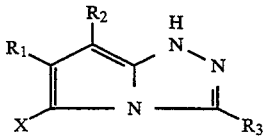

formula (II-b)

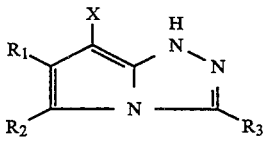

wherein $R_1$, $R_2$, $R_3$, and X each have the same meanings as defined in formula (I) or (II).

$R_3$ represents a hydrogen atom or a substituent and as the substituent, for example, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and azolyl group can be mentioned, which may further be substituted by such substituents as those mentioned as examples of $R_3$.

More particularly, $R_3$ represents a hydrogen atom, a halogen atom (e.g., a chlorine atom and a bromine atom), an alkyl group (e.g., a straight-chain or branched-chain alkyl group having 1 to 32 carbon atoms, an aralkyl group, an alkenyl group, an alkynyl group, a cycloalkyl group, and a cycloalkenyl group, such as methyl, ethyl, propyl, isopropyl, t-butyl, tridecyl, 2-methanesulfonylethyl, 3-(3-pentadecylphenoxy)-propyl, 3-{4-{2-[4-(4-hydroxyphenylsulfonyl)phenoxy]-dodecanamido}phenylpropyl, 2-ethoxytridecyl, trifluoromethyl, cyclopentyl, and 3-(2,4-di-t-amylphenoxy)-propyl), an aryl group (e.g., phenyl, 4-t-butylphenyl, 2,4-di-t-amylphenyl, and 4-tetradecanamidophenyl), a heterocyclic group (e.g., 2-furyl, 2-thienyl, 2-pyrimidyl, and 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxyphenoxy)-dodecanamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic-oxy group (e.g., 1-phenyltetrazole-5-oxy and 2-tetrahydropyranyloxy), an azo group (e.g., phenylazo, 4-methoxyphenylazo, 4-pivaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-di-phenoxy-1,3,5-triazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, and 4-dodecyloxybenzoyl), or an azolyl group (e.g., imidazolyl, pyrazolyl, 3-chloro-pyrazol-1-yl, and triazolyl).

Preferably $R_3$ represents, for example, an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an acyloxy group, a carbamoyloxy group, an aryloxycarbonylamino group, an imido group, a heterocyclic-thio group, a sulfinyl group, a phosphonyl group, an aryloxycarbonyl group, an acyl group, or an azolyl group.

More preferably, $R_3$ represents an alkyl group or an aryl group, which, in view of cohesiveness, preferably has at least one substituent, and further more preferably $R_3$ represents an alkyl group or an aryl group having at least one alkoxy group, sulfonyl group, sulfamoyl group, carbamoyl group, acylamido group, or sulfonamido group as a substituent. Particularly preferably $R_3$ represents an alkyl group or an aryl group having at least one acylamido group or sulfonamido group as a substituent. If there is such a substituent on the aryl group, the substituent is preferably at least in the ortho position.

In the cyan coupler of the present invention, $R_1$ and $R_2$ are both electron-attracting groups having Hammett substituent constant $\sigma_p$ values of 0.20 or over and the sum of the $\sigma_p$ values of $R_1$ and $R_2$ is 0.65 or over, so that color formation for a cyan image is made. The sum of the $\sigma_p$ values of $R_1$ and $R_2$ is preferably 0.70 or over and the upper limit thereof is preferably about 1.8.

Preferably $R_1$ and $R_2$ are electron-attracting groups having Hammett substituent constant $\sigma_p$ values of 0.30 or over. Preferably the upper limit of the Hammett substituent constant $\sigma_p$ values of the electron-attracting groups is 0.1. The Hammett rule is an empirical rule advocated by L. P. Hammett in 1935 to discuss quantitatively the influence of substituents on reactions or equilibria of benzene derivatives, and its appropriateness is now widely recognized.

Substituent constants determined by the Hammett rule include $\sigma_p$ and $\sigma_m$ values and many of them are listed in common books; for example they are listed in detail by J. A. Dean in *Lange's Handbook of Chemistry,* Vol. 12, 1979 (Mc Graw-Hill), and in *Kagaku no Ryoiki, an extra issue,* No. 122, pages 96 to 103, 1979 (Nankodo). In the present invention, although $R_1$ and $R_2$ are defined by Hammett substituent constant $\sigma_p$ values, the substituents represented by $R_1$ and $R_2$ are of course not limited to only those substituents whose Hammett substituent constant $\sigma_p$ values are known and listed in these books, but also include substituents whose Hammett substituent constant $\sigma_p$ values are not known in the literature but fall in the above ranges when measured based on the Hammett rule.

Specific examples of the electron-attracting groups $R_1$ and $R_2$ having $\sigma_p$ values of 0.20 or over include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by other electron-attracting group having a $\sigma_p$ value of 0.20 or over, a heterocyclic group, a halogen atom, an azo group, and a selenocyanate group. Out of these substituents, those substituents which can have a further substituent may have such a substituent as described for $R_3$.

In more detail, examples of the electron-attracting groups represented by $R_1$ and $R_2$ whose $\sigma_p$ value is 0.20 or over include an acyl group (e.g., acetyl, 3-phenylpropanoyl, benzoyl, and 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, and N-{3-(2,4-di-t-amylphenoxy)propyl}carbamoyl), an alkoxycarbonyl group (e.g., methoxycarbonyl, ethoxycarbonyl, iso-propyloxycarbonyl, tertbutyloxycarbonyl, isobutyloxycarbonyl, butyloxycarbonyl, dodecyloxycarbonyl, and octadecyloxycarbonyl), an aryloxycarbonyl group (e.g., a phenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl and octanesulfonyl), an arylsulfonyl group (e.g., benzenesulfonyl and toluenesulfonyl), a sulfonyloxy group (e.g., methanesulfonyloxy and toluenesulfonyloxy), an acylthio group (e.g., acetylthio and benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a thiocyanate group, a thiocarbonyl group (e.g., methylthiocarbonyl and phenylthiocarbonyl), a halogenated alkyl group (e.g., trifluoromethane and heptafluoropropane), a halogenated alkoxy group (e.g., trifluoromethyloxy), a halogenated aryloxy group (e.g., pentachlorophenyloxy), a halogenated alkylamino group (e.g., N,N-di-(trifluoromethyl)amino), a halogenated alkylthio group (e.g., difluoromethylthio and 1,1,2,2-tetrafluoroethylthio), an aryl group substituted by other electron-attracting group whose $\sigma_p$ value is 0.20 or over (e.g., 2,4-dinitrophenyl, 2,4,6-trichlorophenyl, and pentachlorophenyl), a heterocyclic group (e.g., 2-benzoxazolyl, 2-benzothiazolyl, 1-phenyl-2-benzimidazolyl, 5-chloro-1-tetrazolyl, and 1-pyrrolyl), a halogen atom (e.g., a chlorine atom and a bromine atom), an azo group (e.g., phenylazo), and a selenocyanate group.

Preferably, $R_1$ and $R_2$ each represent, for example, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by two or more other electron-attracting groups whose $\sigma_p$ is 0.20 or over, or a heterocyclic group, with more preference given to an acyl group, an alkoxycarbonyl group, an aryloxycarbonyl group, a nitro group, a cyano group, an arylsulfonyl group, a carbamoyl group, or a halogenated alkyl group.

Most preferably $R_1$ represents a cyano group. $R_2$ represents particularly preferably an aryloxycarbonyl group or an alkoxycarbonyl group, and most preferably a branched alkoxycarbonyl group or an alkoxycarbonyl group having an electron-attracting group.

X represents a hydrogen atom or a group capable of being released upon coupling reaction with the oxidized product of an aromatic primary amine color developing agent (a coupling-off group) and in particular the coupling-off group includes, for example, a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkylthio group, an arylthio group, a heterocyclic-thio group, an alkylsulfinyl group, an arylsulfinyl group, a carbamoylamino group, a 5- or 6-membered nitrogen-containing heterocyclic group, an imido group, and an arylazo group, which may further be substituted by a group allowable as a substituent of $R_3$.

More particularly, X represents, for example, a halogen atom (e.g., a fluorine atom, a chlorine atom, and a bromine atom), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (e.g., acetoxy, tetradecanoyloxy and benzoyloxy), an alkylsulfonyloxy or arylsulfonyloxy group (e.g., methanesulfonyloxy and toluenesulfonyloxy), an acylamino group (e.g., dichloroacetylamino and heptafluorobutylylamino), an alkylsulfonamido or arylsulfonamido group (e.g., methanesulfonamino, trifluoromethanesulfonamino, p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an alkylthio, arylthio, or heterocyclic-thio group (e.g., dodecylthio, 1-carboxydodecylthio, phenylthio, 2-butoxy-5-t-octylphenylthio, and tetrazolylthio), an alkylsulfinyl or arylsulfinyl group (e.g., isopropylsulfinyl and phenylsulfinyl), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxo-1-pyridyl), an imido group (e.g., succinimido and hydantoinyl), or an arylazo group (e.g., phenylazo and 4-methoxyphenylazo). Further, X may be in the form of a bis-type coupler obtained by condensing a 4-equivalent coupler with aldehydes or ketones as a coupling-off group bonded through the carbon atom. X may also contain a photographically useful group such as a development restrainer and a development accelerator.

Preferably, X represents a halogen atom, an alkoxy group, an aryloxy group, an alkylthio or arylthio group, an alkylsulfinyl or arylsulfinyl group, or a 5- or 6-membered nitrogen-containing heterocyclic group bonded through the nitrogen atom to the coupling active site, more preferably a halogen atom, an alkylthio or arylthio group, or an alkylsulfinyl or arylsulfinyl group, and particularly preferably an arylthio group or an arylsulfinyl group.

With respect to the cyan coupler represented by formula (I) or (II), $R_1$, $R_2$, $R_3$, or X may be a divalent group to form a dimer or more higher polymer or to bond to a polymer chain to form a homopolymer or copolymer. A typical example of the homopolymer or copolymer formed by bonding to a polymer chain is a simple polymer or copolymer of an addition-polymerizable ethylenically unsaturated compound having a cyan coupler residue represented by formula (I) or (II). In this case, with respect to the cyan color-forming repeating unit having a cyan coupler residue represented by formula (I) or (II), one or more different types of such units may be contained in the polymer, and the copolymer may contain one or more non-color-forming ethylenically unsaturated monomers as copolymerization components. The cyan color-forming repeating unit having a cyan coupler residue represented by formula (I) or (II) is preferably represented by the following formula (P):

formula (P)

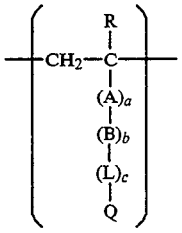

wherein R represents a hydrogen atom, an alkyl group having 1 to 4 carbon atoms, or a chlorine atom, A represents —CONH—, —COO—, or a substituted or unsubstituted phenylene group, B represents a substituted or unsubstituted alkylene group, phenylene group, or aralkylene group, L represents —CONH—, —NHCONH—, —NHCOO—, —NHCO—, —OCONH—, —NH—, —COO—, —OCO—, —CO—, —O—, —S—, $—SO_2—$, $—NHSO_2—$, or $—SO_2NH—$, a, b, and c are each 0 or 1, and Q represents a cyan coupler residue formed by releasing a hydrogen atom from $R_1$, $R_2$, $R_3$, or X of a compound represented by formula (I) or (II).

Preferably the polymer is a copolymer of the cyan color-forming monomer represented by the coupler unit of formula (I) or (II) with a non-color-forming ethylenically unsaturated monomer that does not couple with the oxidation product of an aromatic primary amine developing agent.

The non-color-forming ethylenically unsaturated monomer that does not couple with the oxidation product of an aromatic primary amine developing agent includes, for example, acrylic acid, α-chloroacrylic acid, an α-alkylacrylic acid (e.g., methacrylic acid), an amide or ester derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxymethacrylate), a vinyl ester (e.g., vinyl acetate, vinyl propionate, and vinyl laurate), acrylonitrile, methacrylonitrile, an aromatic vinyl compound (e.g., styrene and its derivatives, such as vinyltoluene, divinylbenzene, vinylacetophenone, and sulfostyrene), itaconic acid, citraconic acid, crotonic acid, vinylidene chloride, a vinyl alkyl ether (e.g., vinyl ethyl ether), a maleate, N-vinyl-2-pyrrolidone, N-vinylpyridine, 2-vinylpyridine, and 4-vinylpyridine.

In particular, acrylates, methacrylates, and maleates are preferable. Two or more of these non-color-forming ethylenically unsaturated monomers can be used in combination. For example, use is made of a combination of methyl acrylate with butyl acrylate, a combination of butyl acrylate with styrene, a combination of butyl methacrylate with methacrylic acid, or a combination of methyl acrylate with diacetone acrylamide.

As is well known in the field of polymer couplers, the ethylenically unsaturated monomer to be copolymerized with a vinyl monomer corresponding to formula (I) or (II) can be selected such that the physical properties and/or chemical properties of the copolymer to be formed, such as the solubility, the compatibility with the binder in the photographic colloid composition, for example with gelatin, the flexibility, and the heat stability, are favorably influenced.

To incorporate the cyan coupler of the present invention into the silver halide photographic material—preferably into the red sensitive silver halide emulsion layer—preferably the cyan coupler is made into a so-called incorporated coupler, and, for that purpose, preferably at least one group of $R_1$, $R_2$, $R_3$, and X is a ballasting group (preferably having a total number of carbon atoms of 10 or more, more preferably 10 to 50).

In the present invention, a cyan coupler represented by formula (I) is preferable in view of the effects, for example, for the hue, the color image stability, and the color-forming property, and the cyan coupler represented by formula (I-a) is particularly preferable in view of the above effects.

Specific examples of the coupler of the present invention are shown below, but the present invention is not restricted to them.

C-1

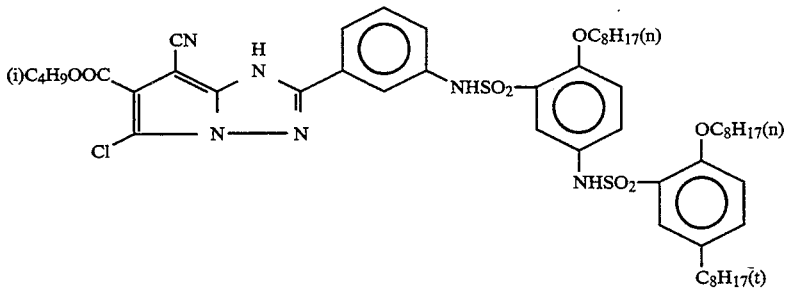

-continued
C-2
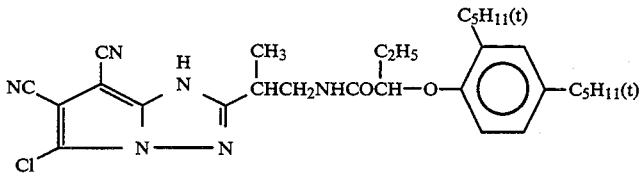
C-3
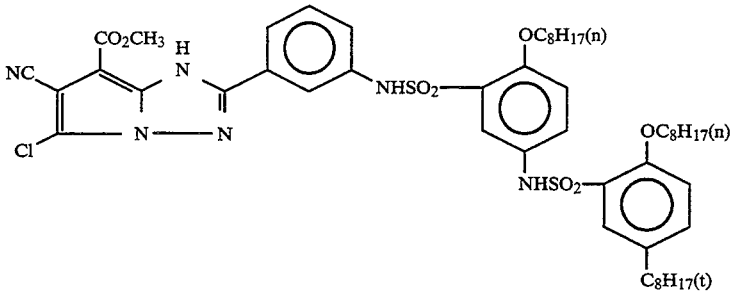
C-4
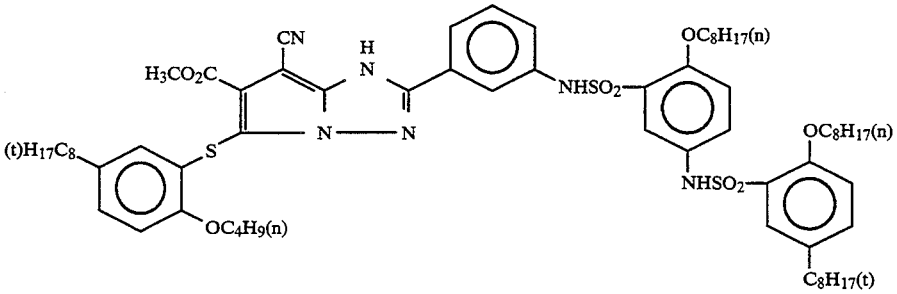
C-5
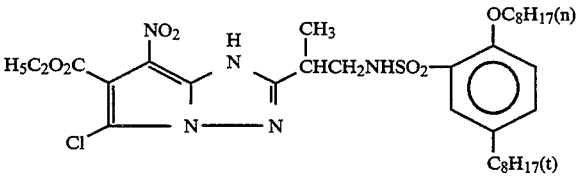
C-6
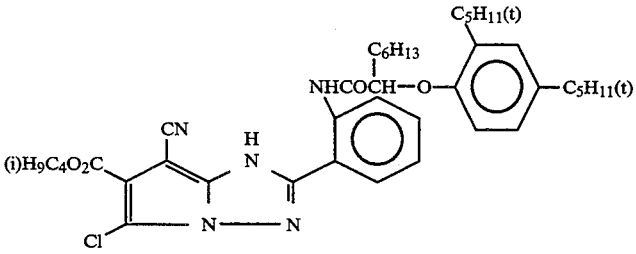
C-7
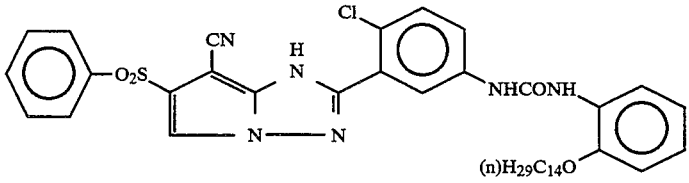
C-8
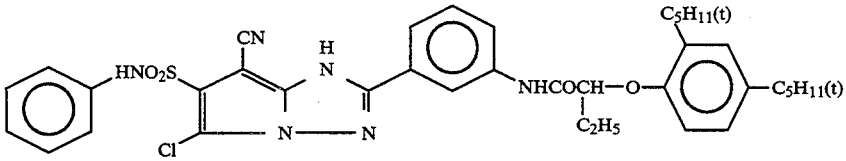

-continued
C-9
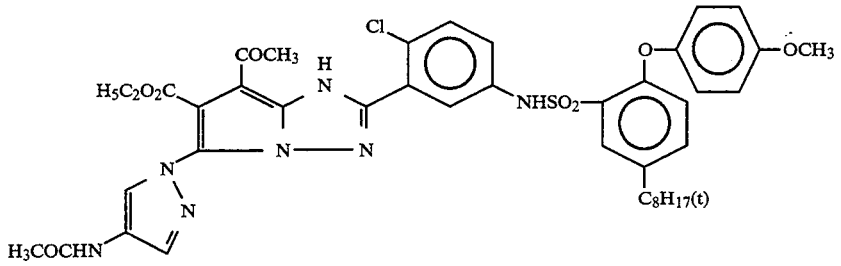
C-10
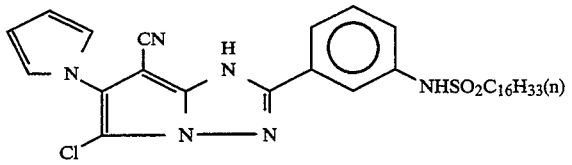
C-11
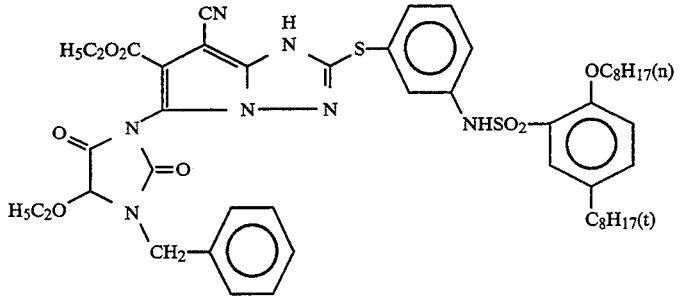
C-12
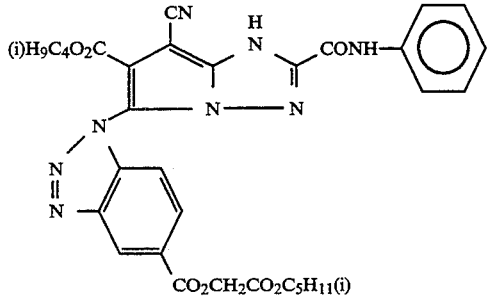
C-13
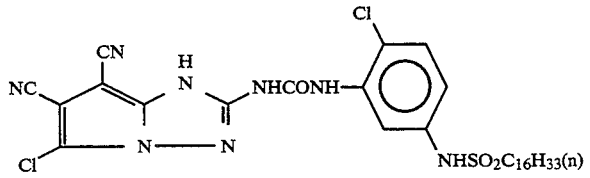
C-14
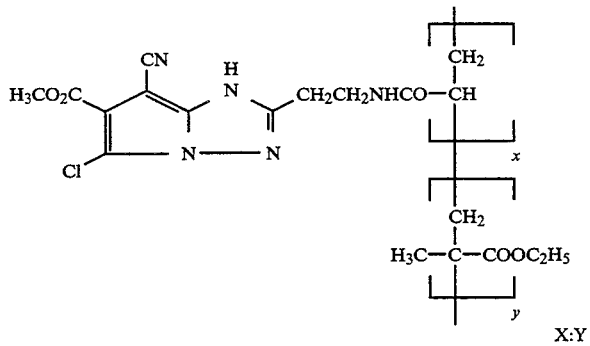
X:Y = 50:50

-continued
C-15
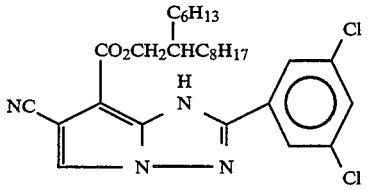
C-16
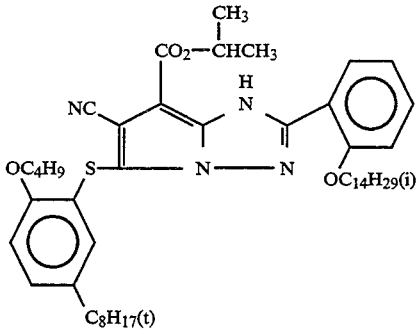
C-17
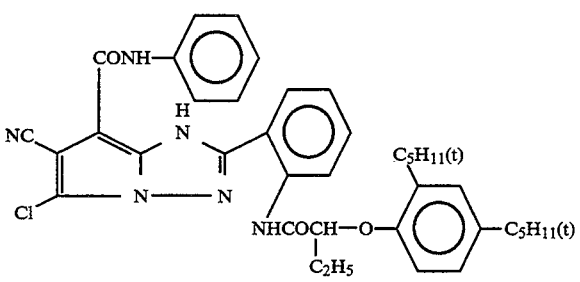
C-18
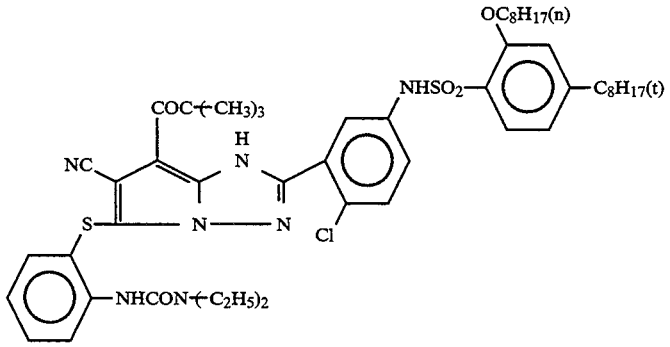
C-19
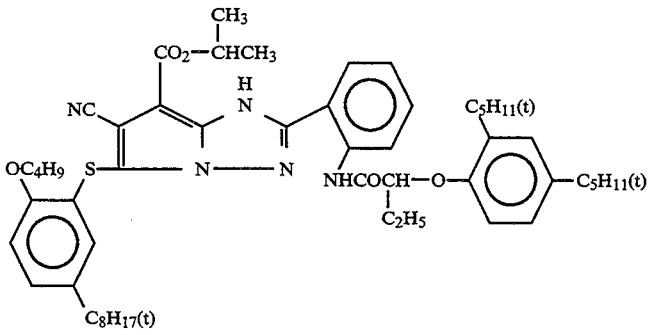

-continued
C-20
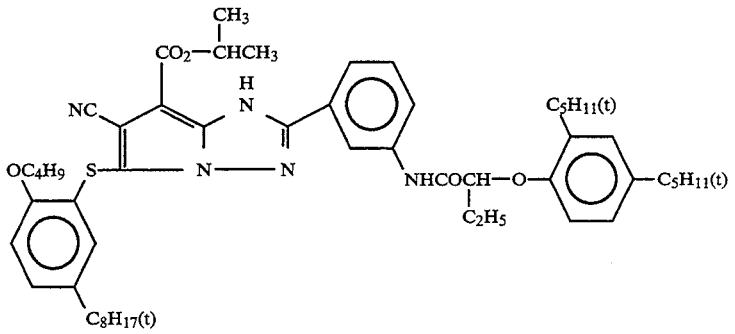
C-21
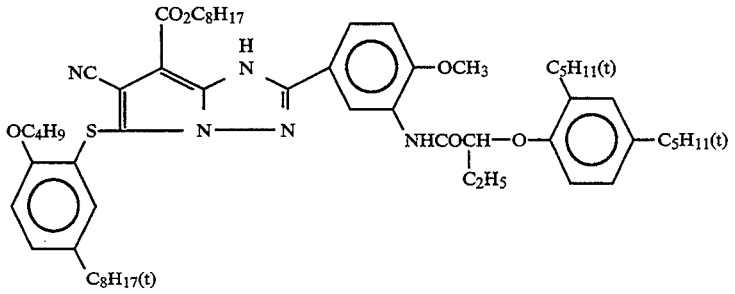
C-22
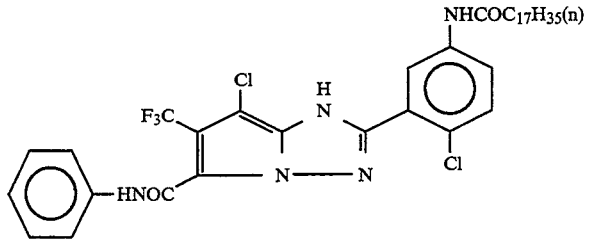
C-23
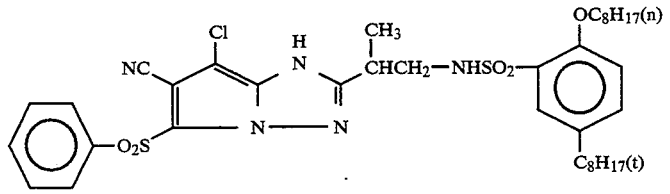
C-24
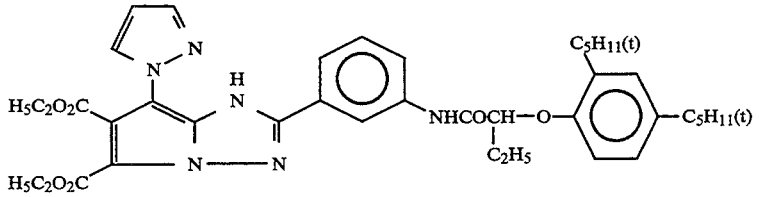
C-25
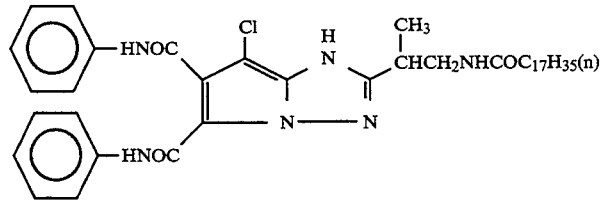

-continued
C-26
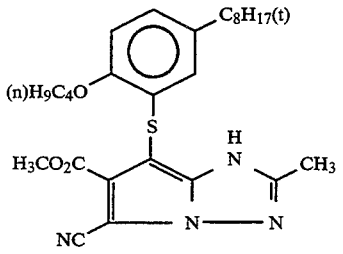
C-27
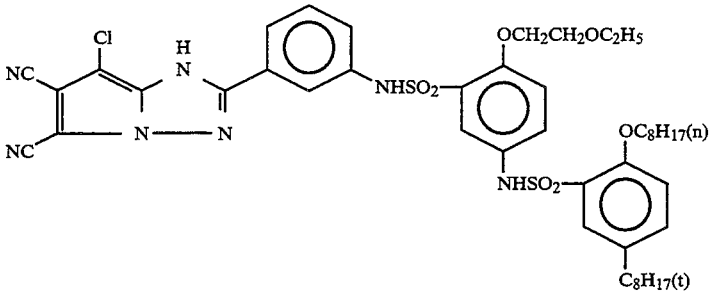
C-28
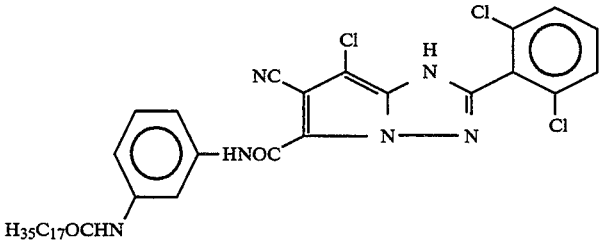
C-29
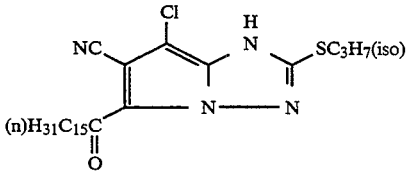
C-30
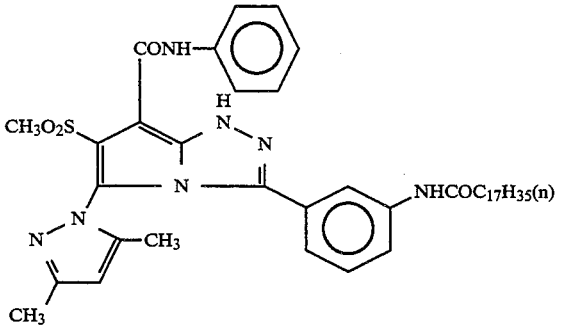
C-31
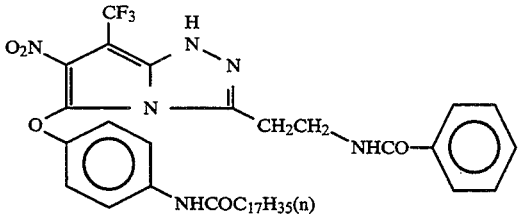

-continued
C-32
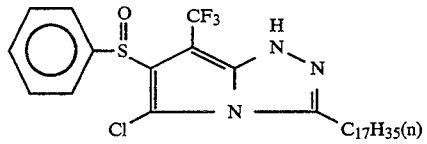
C-33
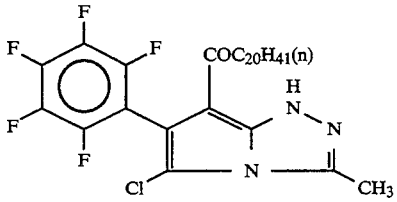
C-34
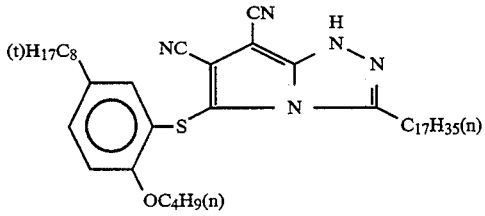
C-35
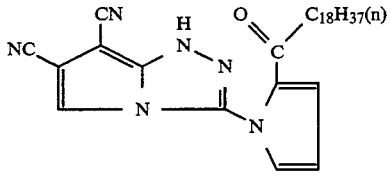
C-36
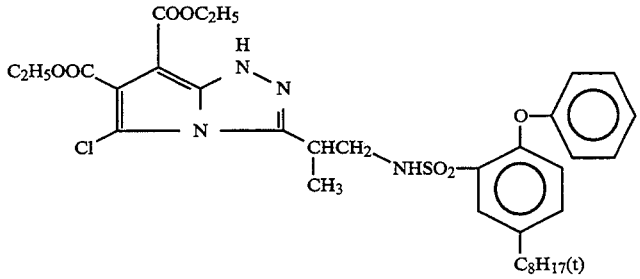
C-37
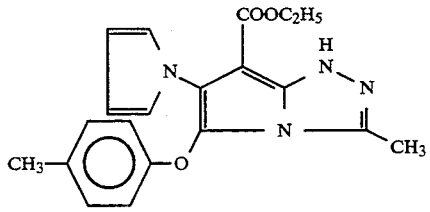
C-38
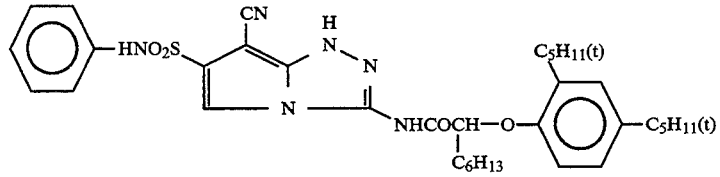

-continued
C-39
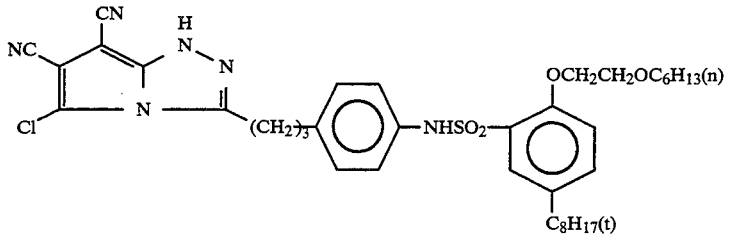
C-40
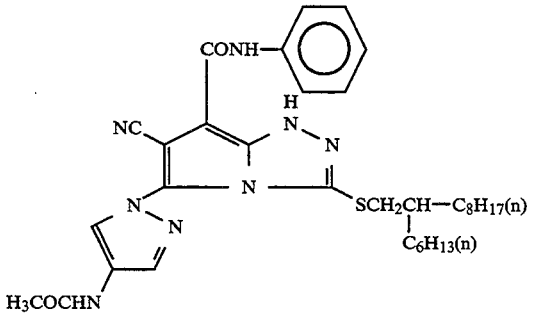
C-41
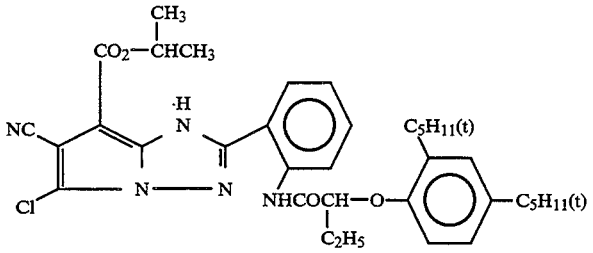
C-42
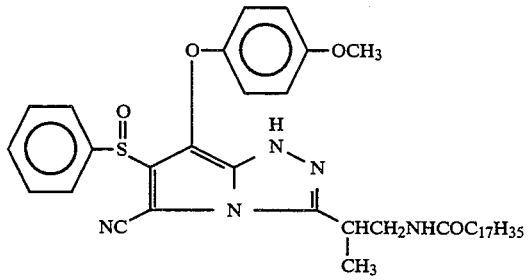
C-43
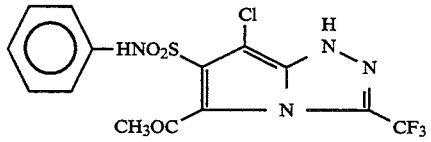
C-44
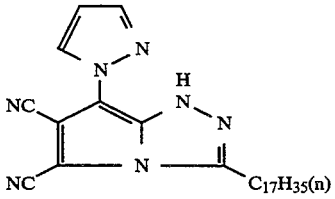

-continued
C-45
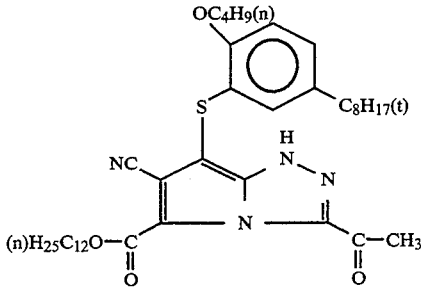
C-46
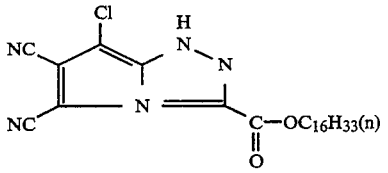
C-47
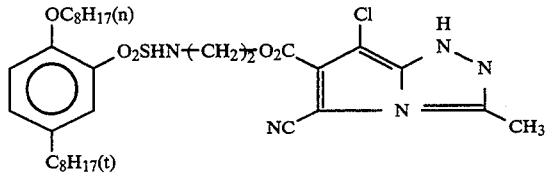
C-48
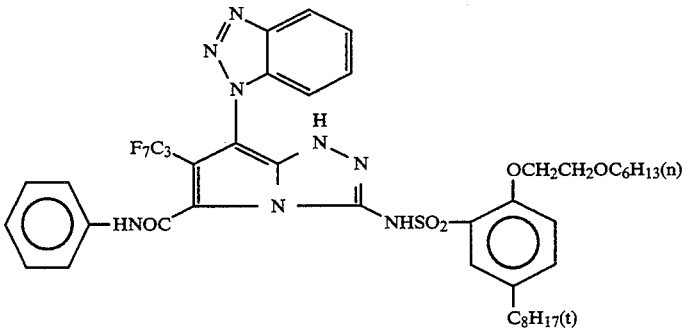
C-49
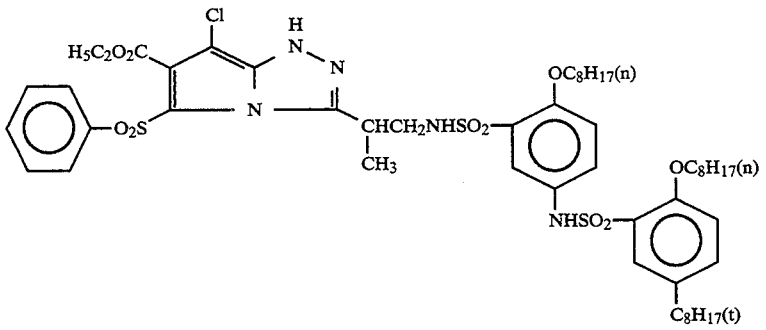

-continued
C-50
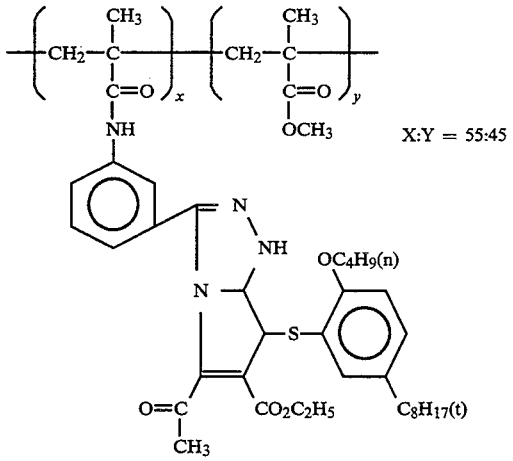
C-51
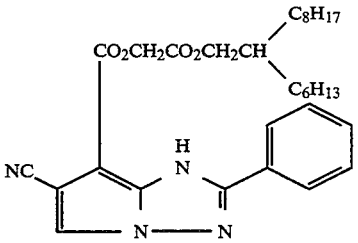
C-52
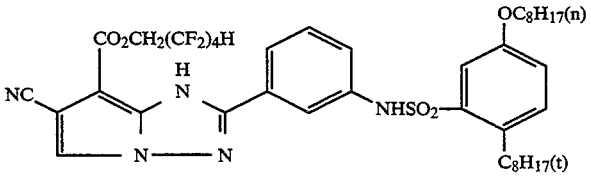
C-53
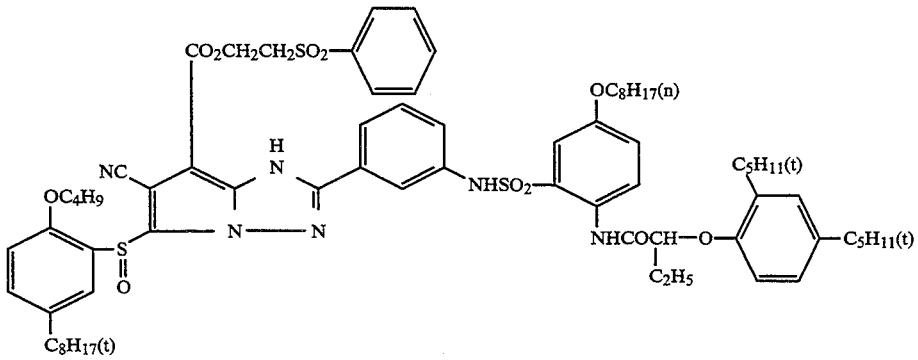
C-54
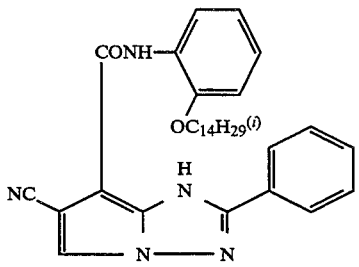

-continued
C-55
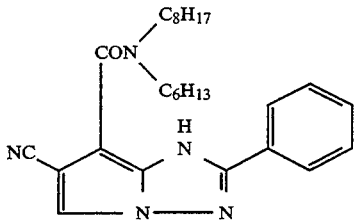
C-56
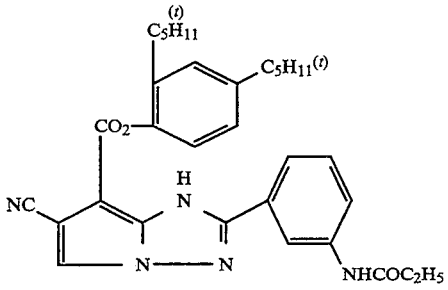
C-57
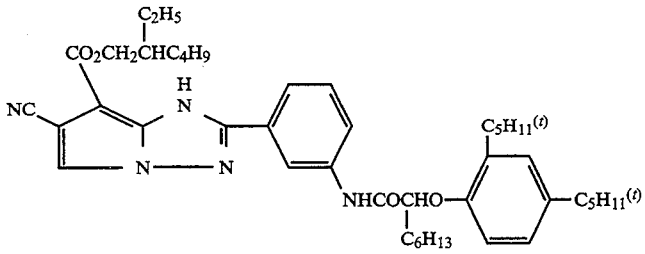
Now, Synthesis Examples of the cyan coupler of the present invention are shown to describe methods of the synthesis.
Synthesis Example 1 (Synthesis of Exemplified Compound C-1)
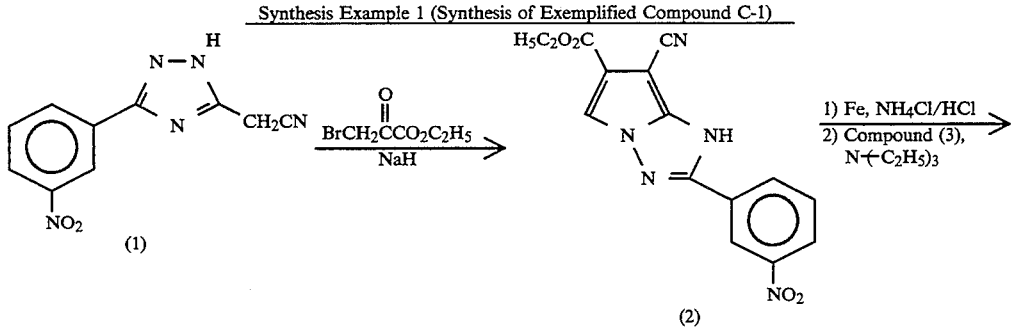
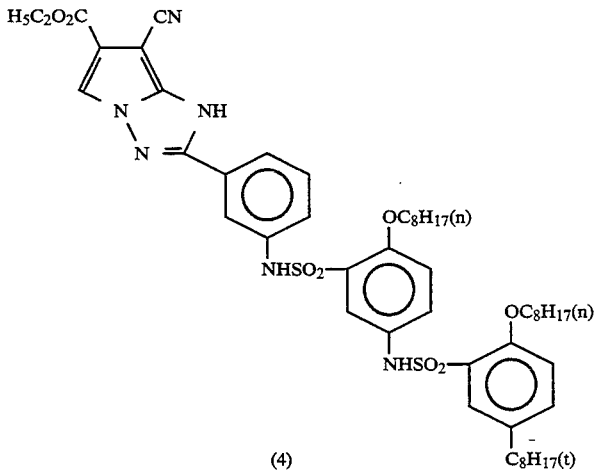

-continued

Synthesis Example 1 (Synthesis of Exemplified Compound C-1)

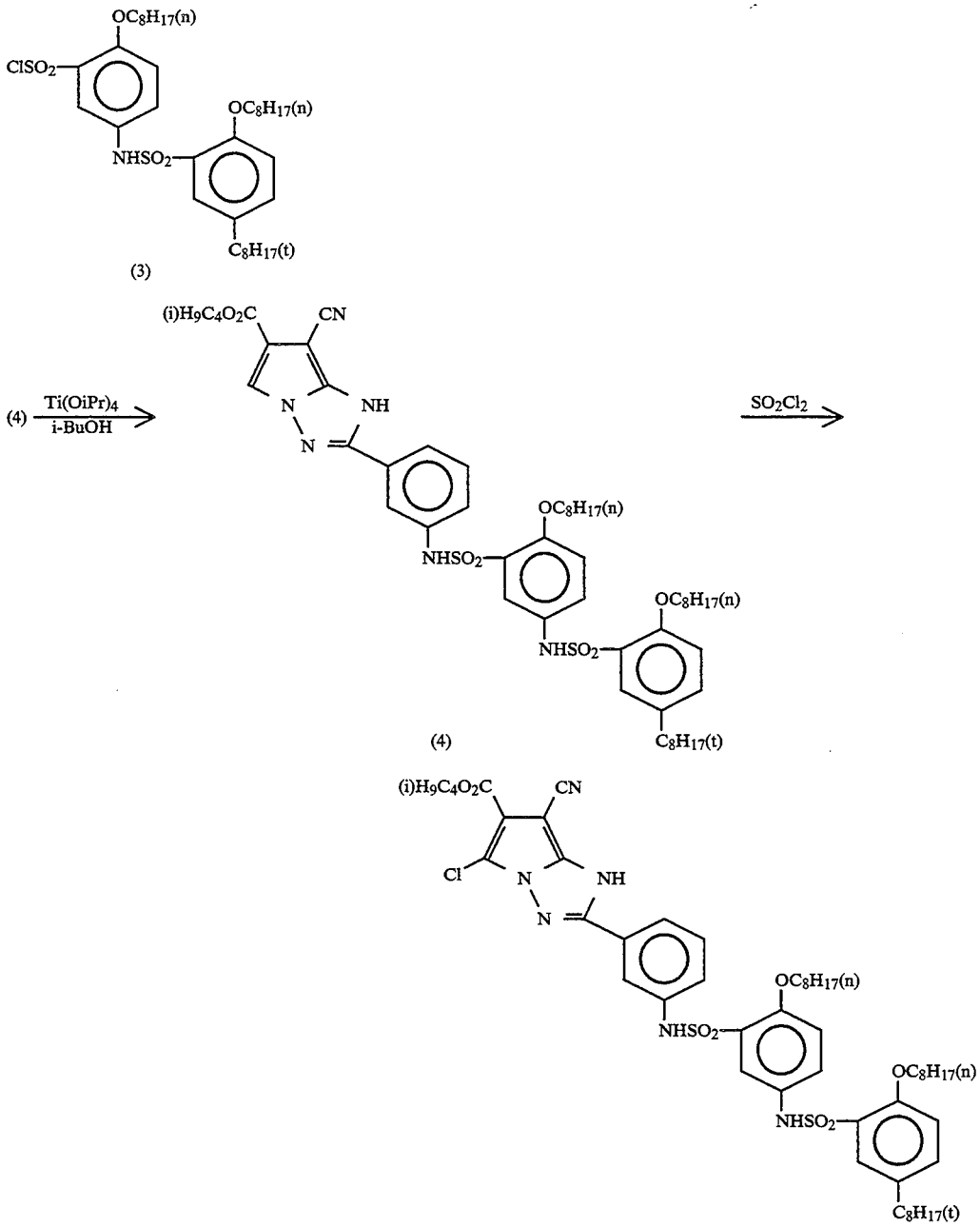

Exemplified Compound C-1

3-m-Nitrophenyl-5-methylcyano-1,2,4-triazole (1) (20.0 g, 87.3 mmol) was dissolved in 150 ml of dimethylacetamide; then NaOH (60% in oil) (7.3 g, 183 mmol) was added little by little to the solution, and the mixture was heated to 80° C. A solution of ethyl bromopyruvate (13.1 ml, 105 mmol) in 50 ml of dimethylacetamide was added dropwise thereto slowly. After the addition, the mixture was stirred for 30 min at 80° C. and then was cooled to room temperature. Then, after 1N hydrochloric acid was added to the reaction liquid to make the reaction liquid acid, extraction with ethyl acetate was carried out; the organic layer was dried over Glauber's salt; and the solvent was distilled off under reduced pressure. The residue was purified by silica gel chromatography and 10.79 g (38%) of Compound (2) was obtained.

Reduced iron (9.26 g, 166 mmol) and ammonium chloride (0.89 g, 16.6 mmol) were suspended in 300 ml of isopropanol; then 30 ml of water and 2 ml of concentrated hydrochloric acid were added and the mixture was heated for 30 min under reflux. While heating the mixture under reflux, Compound (2) (10.79 g, 33.2 mmol) was added little by little. After 4 hours of the heating under reflux, the reaction mixture was filtered through celite and the filtrate was distilled under reduced pressure. The residue was dissolved in a mixture of 40 ml of dimethylacetamide and 60 ml of ethyl acetate, and after Compound (3) (25.6 g, 36.5 mmol) was added to the solution, triethylamine (23.1 ml, 166 mmol) was added thereto, followed by heating at 70° C. for 5 hours. After the reaction liquid was cooled to room temperature, water was added and extraction with ethyl acetate was carried out. Then, after the extract was washed with water, it was dried over Glauber's salt and the solvent was distilled off under reduced pressure. The residue was purified by silica gel chromatography, and 16.5 g (52%) of Compound (4) was obtained.

The Compound (4) (7.0 g, 7.30 ml) was dissolved in 14 ml of isobutanol, and then tetraisopropyl orthotitanate (0.43 ml, 1.46 mmol) was added to the solution followed by heating under reflux for 6 hours. The reaction liquid was cooled to room temperature, water was added thereto, and extraction with ethyl acetate was carried out. The extract was dried over Glauber's salt, and the solvent was distilled off under reduced pressure. The residue was purified by silica gel chromatography, and 5.0 g (69%) of Compound (5) was obtained.

The Compound (5) (5.0 g, 5.04 mmol) was dissolved in 50 ml of tetrahydrofuran and then $SO_2Cl_2$ (0.40 ml, 5.04 mmol) was added dropwise to the solution under cooling with water, followed by stirring for 4 hours under cooling with water. Water was added to the reaction liquid, extraction with ethyl acetate was carried out, the extract was dried over Glauber's salt, and the solvent was distilled off under reduced pressure. The residue was purified by silica gel chromatography and 3.9 g (76%) of Exemplified Compound C-1 could be obtained.

mmol), and then a solution of sodium nitrite (2.95 g, 42.7 mmol) in 5.9 ml of water was added dropwise slowly thereto with stirring under cooling with ice, followed by stirring for 1.5 hours, thereby synthesizing Compound (7). The solution of the thus synthesized Compound (7) was added dropwise slowly under cooling with ice to a solution prepared by adding 102 ml of 28% sodium methylate to 177 ml of a solution of Compound (8) (9.58 g, 427 mmol) in ethanol with stirring under cooling with ice. The stirring was continued for a further 1 hour. Then the reaction liquid was heated under reflux for 1.5 hours with stirring. Thereafter, the ethanol was distilled off from the reaction liquid under reduced pressure; the residue was dissolved in chloroform; the solution was washed with saturated table salt solution and was dried over Glauber's salt; and the chloroform was distilled off under reduced pressure. The residue was purified by silica gel column chromatography, and 4.19 g (yield: 29% based on Compound (6)) of Compound (10) was obtained.

The synthesis of Compound (6) was carried out in such a way that the above 3,4-dicyanopyrrole was chlorinated, then nitrated, and reduced with iron. By following the method described in *Journal of the American Chemical Society,* 76, 3209 (1954), Compound (8) was synthesized from Compound (a) synthesized from γ-lactone and benzene in the known manner.

Synthesis Example 2 (Synthesis of Exemplified Compound C-39

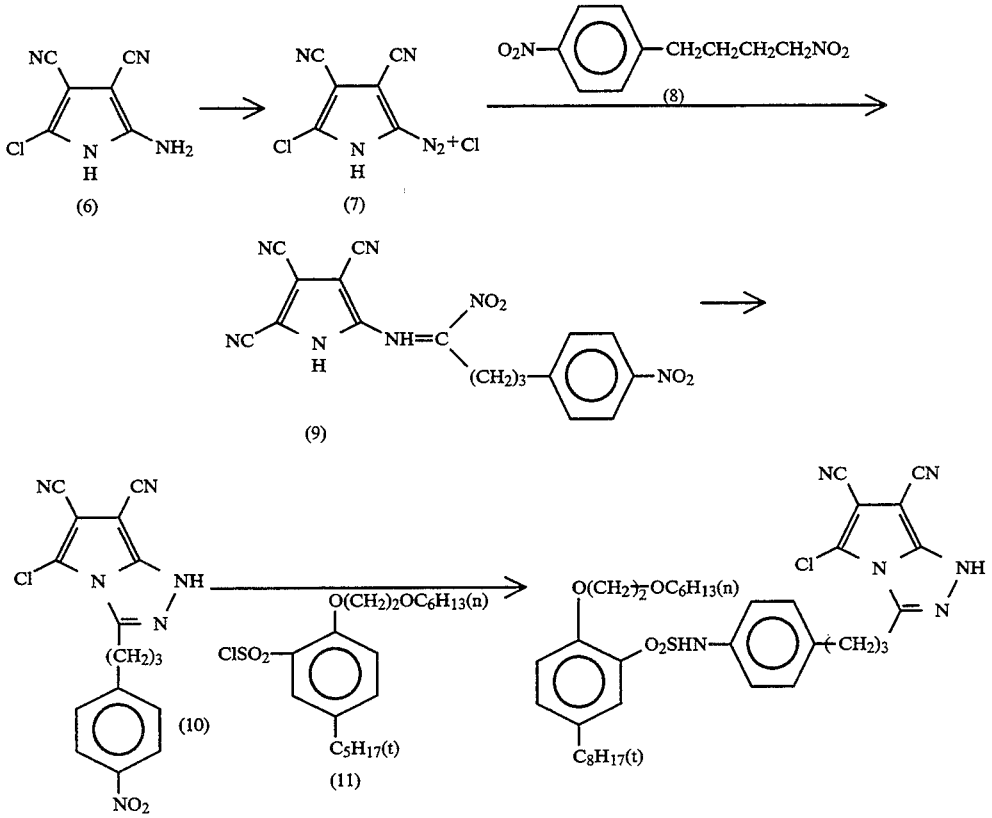

Exemplified Compound C-39

38 Milliliters of 36% hydrochloric acid was added to 2-amino-5-chloro-3,4-dicyanopyrrole (6) (6.78 g, 4.07

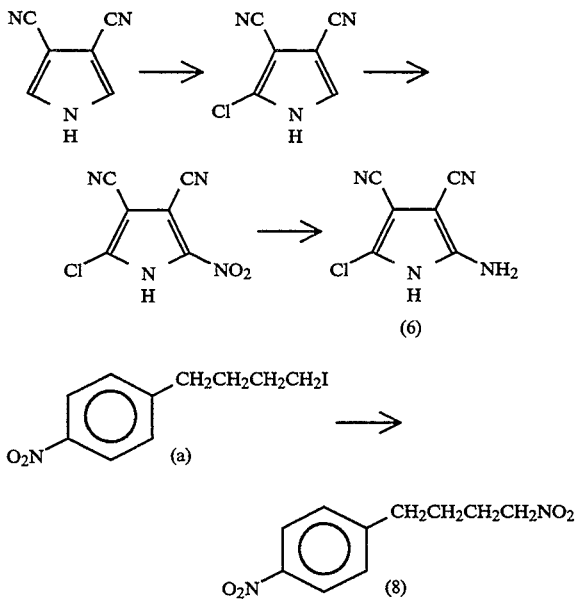

10 Milliliters of water, ammonium chloride (0.3 g, 5.9 mmol), and acetic acid (0.34 ml, 5.9 mmol) were added to reduced powder iron (3.3 g, 59.0 mmol), followed by heating for 15 min under reflux with stirring, and thereafter 31 ml of isopropanol was added, followed by heating for 20 min under reflux with stirring. Then, 14 ml of a solution of Compound (10) (4.1 g, 11.8 mmol) in isopropanol was added dropwise thereto; then, after heating the mixture for 2 hours under reflux with stirring, the reaction liquid was filtered using celite as a filter aid, the residue was washed with ethyl acetate, and the solution was distilled under reduced pressure.

The residue was dissolved in a mixture of 16 ml of ethyl acetate and 24 ml of dimethylacetamide, and then Compound (11) (5.6 g, 13.0 mmol) and then triethylamine (8.2 ml, 59.0 mmol) were added to the solution, followed by stirring for 4 hours at room temperature. Water was added to the reaction mixture; extraction with ethyl acetate was carried out; and the extract was washed with a saturated table salt solution. After the extract was dried over Glauber's salt, the solvent was distilled off; the residue was purified by silica gel chromatography; and Exemplified Compound C-39 was obtained in an amount of 6.46 g (76%).

The amount of the coupler of the present invention to be added to the photographic material is $1\times10^{-3}$ to 1 mol, preferably $2\times10^{-3}$ to $5\times10^{-1}$ mol, per mol of the silver halide.

The coupler of the present invention can be introduced into the photographic material in various known dispersing ways, and preferably the oil-in-water dispersion method is used, wherein the coupler is dissolved in a high-boiling organic solvent (if necessary in combination with a low-boiling organic solvent) and then emulsified and dispersed in an aqueous gelatin solution to be added to a silver halide emulsion.

Examples of the high-boiling solvent used in the oil-in-water dispersion method are described, for example, in U.S. Pat. No. 2,322,027. Specific examples of steps, effects, and latexes for impregnation of the latex dispersion method, which is a polymer dispersion method, are described, for example, in U.S. Pat. No. 4,199,363, West German Patent Application (OLS) Nos. 2,541,274 and 2,541,230, JP-B ("JP-B" means examined Japanese patent publication) No. 41091/1978, and European Patent Publication (EP) No. 029104; and the dispersion method by an organic solvent-soluble polymer is described in PCT International Publication specification No. WO 88/00723. In dispersing and emulsifying, compounds described in EP No. 0435179A2, pages 21 to 71, can be used.

The weight ratio of the high-boiling organic solvent to be used is from 0 to 6.0 times, preferably from 0 to 4.0 times, the weight of the coupler.

To the present method of forming a color image, for example, photographic materials, such as color papers, color reversal papers, direct positive color photographic materials, color negative films, color positive films, and color reversal films, can be applied. Above all, the application to color photographic materials having a reflective base (e.g., color papers and color reversal papers) is preferable.

As the silver halide emulsion used in the present invention, high-silver chloride grains containing 0.01 to 3 mol % of silver iodide on the emulsion surface, as described in JP-A ("JP-A" means unexamined published Japanese patent application) No. 84545/1991, are preferably used for the purpose of heightening the adaptability to high-intensity exposure, increasing the sensitivity to infrared spectral sensitization, or heightening the stability. Also, grains comprising silver chloride or silver bromochloride substantially free from silver iodide are preferably used in order to make the development processing time shortened. Herein, the expression "substantially free from silver iodide" means that the silver iodide content is 1 mol % or below, preferably 0.2 mol % or below. The halogen composition of the emulsion may be the same or different from grain to grain and if the halogen composition of the emulsion is the same from grain to grain, the properties of the grains may be made uniform easily among the grains. With respect to the halogen composition distribution in the silver halide emulsion grains, for example, grains having a so-called uniform structure, wherein the composition of any part of the silver halide grains is the same, or grains having a so-called laminated structure, wherein the halogen composition of the core in the silver halide grains is different from that of the shell (consisting of a layer or layers) surrounding the core, or grains having a structure wherein there are non-layered parts in the grain or on the surface of the grain where the halogen composition is different from part to part (if these parts are on the surface of the grain, the structure is such that the parts different in composition are joined to the edges, corners, or the planes of the grain), may be suitably selected for use. To obtain high sensitivity, the use of one of the latter two is more advantageous than the use of grains having a uniform structure, and is preferable in consideration of the pressure resistance. When the silver halide grains have the above structures, the boundary of parts that differ in halogen composition may be a distinct boundary, or an obscure boundary where mixed crystal is formed due to the difference in composition, or a boundary where the structure is changed continuously positively.

In a photographic material suitable for rapid processing, a so-called high-silver halide emulsion, wherein the silver chloride content is high, is preferably used. In the present invention, preferably the silver halide content of the high-silver chloride emulsion is 95 mol % or more, more preferably 97 mol % or more.

In such a high-silver halide emulsion, preferably the structure is such that the silver bromide localized phase, which may be in the form of a layer or non-layer, is present in the silver halide grain and/or on the surface of the silver halide grain. The composition of such a localized phase is such that preferably the silver bromide content is at least 10 mol % or more, more preferably 20 mol % or more. The localized phase may be present in the grain, or at the edges or corners on the surface of the grain, or on the planes of the grains, and, as one preferable example, localized phases that are epitaxially grown on the corners of the grain can be mentioned.

For the purpose of lowering the replenishing amount of the development processing liquid, it is also effective to further increase the silver halide content of the silver halide emulsion. In such a case, an emulsion comprising approximately pure silver chloride, wherein the silver halide content is 98 to 100 mol %, is preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 μm to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chlorbromide emulsion used in the present invention can be prepared by methods described, for example, by P. Glafkides, in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

The localized phase of the silver halide grain of the present invention or its substrate preferably contains different metal ions or their complex ions. In the localized phase, use will be made of mainly ions selected from iridium ions, rhodium ions, iron ions, etc. or their complex ions, and in the substrate, use will be made of mainly metal ions selected from osmium ions, iridium ions, rhodium ions, platinum ions, ruthenium ions, palladium ions, cobalt ions, nickel ions, iron ions, etc. or their complex ions in combination. The localized phase and the substrate may be different in the type of metal ions and in the concentration of metal ions. Two or more types of these metals can be used.

Further, ions of such metals as cadmium, zinc, lead, mercury, and thallium, can also be used.

The silver halide emulsion used for photographic materials for scanning exposure by a laser or the like is suitable for high-intensity exposure, and the required gradation is such that the needed density can be obtained in the exposure control range of the laser. Further, if an infrared semiconductor laser is used, infrared spectral sensitization is required and it is required to improve the preservability of image. To these ends, it is very useful to use, out of the above metal ions, particularly ions or complex ions of iridium, rhodium, ruthenium, or iron. Although the amount of these ions or complex ions to be used varies considerably depending, for example, on the silver halide emulsion composition, the size, and the doped position of the doped substrate, iridium or rhodium ion used is preferably in an amount of $5\times10^{-9}$ to $1\times10^{-4}$ mol per mol of silver, and iron ion used is used preferably in an amount of $1\times10^{-7}$ to $5\times10^{-3}$ mol per mol of silver.

These metal-ion-providing compounds are incorporated into the localized phase and/or other grain section (substrate) of the silver halide grains of the present invention, for example, in such a way that they are added into an aqueous gelatin solution serving as a dispersion medium, into an aqueous halide solution, into an aqueous silver salt solution, or into another aqueous solution; or they are added in the form of silver halide fine particles, wherein they are previously incorporated and these fine particles are dissolved.

As to incorporation of metal ions to be used in the present invention into emulsion grains, it is carried out before, during, or immediately after the formation of the grains. This can be changed depending on where the metal ions are to be positioned in the grains.

Generally the silver halide emulsion to be used in the present invention is chemically and spectrally sensitized.

With respect to the chemical sensitization, for example, chemical sensitization using a chalcogen sensitizer (in particular, sulfur sensitization, wherein typically an unstable sulfur compound is added; selenium sensitization by a selenium compound; and tellurium sensitization by a tellurium compound, can be mentioned), noble metal sensitization, represented by gold sensitization, or reduction sensitization, can be used alone or in combination. Concerning compounds used in chemical sensitization, those described in JP-A No. 215272/1987, page 18, the right lower column, to page 22, the right upper column, can be preferably used.

The emulsion to be used in the present invention is a so-called surface latent image type emulsion, wherein a latent image is mainly formed on the grain surface.

To the silver halide emulsion to be used in the present invention, various compounds or their precursors can be added for the purpose of preventing fogging in the step of producing the photographic material, or during the storage of the photographic material, or during the photographic processing, or for the purpose of stabilizing the photographic performance. As specific examples of these compounds, those described in the above-mentioned JP-A No. 215272/1987, pages 39 to 72, can be preferably used. Also 5-arylamino-1,2,3,4-thiatriazole compounds (the aryl residue has at least one electron-attracting group) described in EP No. 0447647 can be preferably used.

The spectral sensitization is carried out for the purpose of rendering the emulsion of each layer of the photographic material of the present invention spectrally sensitive to a desired wavelength region of light. In the present invention, for the exposure to light, it is intended to use monochromatic high-density light, for example, of a laser or LED, and it is required that the spectral sensitization is carried out in conformity with the wavelength of the light fluxes. The expression "to carry out spectral sensitization in conformity with the light fluxes" means to carry out spectral sensitization that uses a sensitizing dye having spectral sensitization in the wavelength of those light fluxes, and it does not necessarily mean that the sensitivity maximum of the spectral sensitization only coincides with the wavelength of those light fluxes. In view of the sensitivity and color separation by these light fluxes, although it is preferable that the wavelength of the light fluxes and the maximum wavelength of the spectral sensitivity coincide, preferable design is also such that the wavelength of the light flux is intentionally shifted from the maximum wavelength of the spectral sensitivity for the purpose of reducing the change in sensitivity due to a change, for example, in the wavelength and intensity of the laser caused by a change in the temperature. In the present invention, it is also preferable to add a dye for absorbing light in the wavelength region corresponding to the intended spectral sensitivity (a spectral sensitizing dye) to a photosensitive layer other than the photosensitive layers subject to the present invention. As the spectral sensitizing dyes used for such spectral sensitization, for example, those described by F. M. Harmar in *Heterocyclic compounds—Cyanine dyes and related compounds* (John Wiley & Sons, New York, London, 1964) can be mentioned. Specific examples of the compounds and methods of spectral sensitization are described in the above-mentioned JP-A No. 215272/1987, page 22, the right upper column, to page 38, and these are preferably used.

In the present invention, if a laser is used as a light source for digital exposure, the green to the infrared region, mainly the red to the infrared region, is required to be spectrally sensitized effectively. In particular, if the region of 730 nm or over is to be spectrally sensitized, sensitizing dyes described in JP-A No. 15049/1991, page 12, the left upper column, to page 21, the left lower column; in JP-A No. 20730/1991, page 4, the left lower column, to page 15, the left lower column; in EP No. 0,420,011, page 4, line 21, to page 6, line 54; in EP No. 0,420,012, page 4, line 12, to page 10, line 33; in EP No. 0,443,466, and in U.S. Pat. No. 4,975,362, are preferably used. These sensitizing dyes are characterized in that they are chemically relatively stable; they can be absorbed relatively strongly onto the surface of silver halide grains, and they firmly resist desorption by coexistent dispersed substances, such as couplers. As the sensitizing dyes for infrared sensitization, particularly compounds whose reduction potential is −1.05 (V/vs/SCE) or a value more negative than that are preferable, and more particularly compound whose reduction potential is −1.10 or a value more negative than that are preferable. Sensitizing dyes having this property are advantageous for high sensitization, in particular for stabilization of sensitivity and latent images.

The measurement of reduction potential can be carried out by phase discrimination secondary higher harmonics AC polarography. As the working electrode, a dropping mercury electrode; as the reference electrode, a saturated calomel electrode; and as the auxiliary electrode, platinum, are used.

The measurement of reduction potential by phase discrimination secondary higher harmonics AC voltammetry using platinum as a working electrode is described in *Journal of Imaging Science,* Vol. 30, pages 27 to 35 (1986).

To incorporate these spectral sensitizing dyes into the silver halide emulsion, these dyes may be directly dispersed into the emulsion, or they may be dissolved in a solvent or a mixture of solvents, such as water, methanol, ethanol, propanol, butanol, methyl Cellosolve, and 2,2,3,3-tetrafluorobutanol, which combinations are then added to the emulsion. Also they may be made into an aqueous solution together with an acid or base, as described in JP-B Nos. 23389/1969, 27555/1969, and 22089/1982, or they may be made into an aqueous solution or colloid dispersion together with a surface-active agent, as described in U.S. Pat. Nos. 3,822,135 and 4,006,025, and the obtained aqueous solution or colloid dispersion may be added to the emulsion. Also, they may be dissolved in a solvent substantially immiscible with water, such as phenoxyethanol, and then dispersed into water or a hydrophilic colloid, and the finally are added to the emulsion. Also they may be directly dispersed into a hydrophilic colloid, as described in JP-A Nos. 102733/1978 and 105141/1983, and the dispersion may be added to the emulsion. The time when the spectral sensitizing dyes are added to the emulsion is that of any known useful step among steps of preparing the emulsion. That is, they are added at any time selected from the time before or during the formation of the grains of the silver halide emulsion, the time before the washing step immediately before the formation of the grains, the time before or during the chemical sensitization, the time immediately after the chemical sensitization and before the cooling and solidification of the emulsion, and the time for preparing the coating liquid. Although most commonly they are added after the completion of the chemical sensitization and before the coating, they may be added at the time when a chemical sensitizer is added, as described in U.S. Pat. Nos. 3,628,969 and 4,225,666, to carry out spectral sensitization and chemical sensitization simultaneously; or the spectral sensitization can be carried out prior to chemical sensitization, as described in JP-A No. 113928/1983, or they can be added before the completion of the formation of the deposit of silver halide grains to start the spectral sensitization. The spectral sensitizing dye may be added in portions; that is to say, it is possible to add a part of the spectral sensitizing dye prior to chemical sensitization and the remaining part after the chemical sensitization; and also the spectral sensitizing dye may be added at any time during the formation of the silver halide grains, for example by a method disclosed in U.S. Pat. No. 4,183,756. Among these, in particular, the spectral sensitizing dye is preferably added in the step of washing the emulsion or before chemical sensitization.

The amount of these spectral sensitizing dyes to be added varies widely depending on the case, and is preferably in the range of $0.5\times10^{-6}$ mol to $1.0\times10^{-2}$ mol, more preferably $1.0\times10^{-6}$ to $5.0\times10^{-3}$ mol, per mol of the silver halide.

In the present invention, particularly if a sensitizing dye having a spectral sensitizing sensitivity in the range from the red region to the infrared region is used, it is preferable to use compounds described in JP-A No. 157749/1990, page 13, the right lower column, to page 22, the right lower column. Use of these compounds can increase the preservability of the photographic material, the stability of the processing, and the effect of the supersensitization in a unique manner. In particular, the use of a combination of compounds of formulas (IV), (V), and (VI) as described in the above JP-A No. 157749/1990 is particularly preferable. These compounds are used in an amount of $0.5\times10^{-5}$ to $5.0\times10^{-2}$ mol, more preferably $5.0\times10^{-5}$ to $5.0\times10^{-3}$ mol, per mol of the silver halide, and a favorable molar ratio of the compounds to be used to the sensitizing dye is in the range of from 1 to 10,000, preferably from 2 to 5,000.

The constitution of the present photographic material will now be described. It is required that the present photographic material has, on the support, at least three silver halide emulsion layers different in color sensitivity, and at least one layer of said layers contains a cyan coupler of the present invention. The present photographic material is used in digital scanning exposure using a monochromatic high-density light, for example, a gas laser, a light-emitting diode, a semiconductor laser or a secondary higher harmonics generating apparatus comprising a combination of a nonlinear optical element with, a semiconductor or a solid state laser. To make the system compact and inexpensive, the use of a secondary higher harmonics generating apparatus comprising of a combination of a nonlinear optical element with a semiconductor laser or a semiconductor laser/solid state laser is preferable. In particular, to design a compact, inexpensive, and stable apparatus having a long life, the use of a semiconductor laser is preferable. To use a semiconductor laser, preferably, at least two layers have a spectral sensitivity maximum of 670 nm or over. This is because the light emission wavelength region of inexpensive stable semiconductor lasers now available is only in the range of from the red region to the infrared region. However on the laboratory level, oscillation of semiconductor lasers in the green region or the blue region is confirmed, and it is well expected that when the technique for producing semiconductors is advanced, these semiconductor lasers will be used inexpensively and stably. In that case, the necessity that at least two layers have a spectral sensitivity maximum of 670 nm or over is reduced.

Although the three different spectral sensitivities can be selected arbitrarily depending on the wavelength of the light source used for digital exposure, preferably the closest spectral sensitivity maximums are separated from each other by at least 30 nm or more. There is no particular restriction on the corresponding relationship between the spectral sensitivities and the color-forming couplers (Y, M, and C) contained in the at least three photosensitive layers (λ1, λ2, and λ3) having different spectral sensitivity maximums. That is, there are 6 possibilities ($3\times2=6$), and in some cases it is preferable that the longest-wavelength photosensitive layer is a yellow color-forming layer in view of the resolving power of human eye. Although also there is no particular restriction on the order of application of the at least three photosensitive layers having different spectral sensitivity maximums onto the base, in some cases it is preferable that the photosensitive layer containing the largest-average-sized silver halide grains is the uppermost layer in view of rapid processing. In some cases, it is preferable that the photosensitive layer having the longest-wavelength spectral sensitivity is the uppermost layer in view of sharpness. In some cases, it is preferable that the lowermost layer is the magenta color-forming layer in view of the preservability of a hard copy under the exposure to light. Therefore, there are 36 possible combinations among the three different spectral sensitivities, the three color-forming couplers, and the orders of the layers. The present invention can be used effectively for all these 36 photographic materials. Specific examples of the digital exposure light sources, the spectral sensitivity maxima, and the color-forming couplers are listed in Table 1, but the present invention is not limited to them.

TABLE 1

| | Digital Scanning Exposure Light Source | | | Spectral |
|---|---|---|---|---|
| | Light Source | Wave-length (run) | Color Formed** | Sensitivity Maximum (nM) |
| 1 | AlGaInAs(670) | 680 | C | 670 |
| | GaAlAs(750) | 750 | Y | 730 |
| | GaAlAs(810) | 810 | M | 810 |
| 2 | AlGaInAs(670) | 670 | Y | 680 |
| | GaAlAs(750) | 750 | M | 750 |
| | GaAlAs(830) | 830 | C | 840 |
| 3 | AlGaInAs(670) | 670 | M | 670 |
| | GaAlAs(750) | 750 | C | 750 |
| | GaAlAs(810) | 810 | Y | 820 |
| 4 | AlGaInAs(670) | 680 | Y | 670 |
| | GaAlAs(780) | 780 | C | 780 |
| | GaAlAs(830) | 830 | M | 840 |
| 5 | AlGaInAs(633) | 633 | Y | 630 |
| | AlGaInAs(680) | 680 | M | 670 |
| | GaAlAs(780) | 780 | C | 780 |
| 6 | GaAlAs(780) | 780 | M | 780 |
| | GaAlAs(830) | 830 | Y | 830 |
| | GaAlAs(880) | 880 | C | 880 |
| 7 | YAG + SHG*(KNbO3) | 473 | Y | 470 |
| | YVO4 + SHG*(KTP) | 532 | M | 550 |
| | AlGaInAs(680) | 680 | C | 700 |
| 8 | GaAs(900) + SHG* | 450 | M | 450 |
| | InGaAs(1200) + SGH* | 600 | C | 580 |
| | AlGaInAs(680) | 680 | Y | 700 |
| 9 | LED(580) | 580 | C | 580 |
| | LED(670) | 670 | M | 670 |
| | LED(810) | 810 | Y | 810 |

Note;
*SHG: Secondary higher harmonics utilizing a nonlinear optical element
**The order of color-forming layers is not specifically restricted.

The exposure to light in the present invention will now be described. The present photographic material is intended to be used for digital exposure of a scanning type, wherein a high-density beam, for example, from a laser or LED, is moved relative to the photographic material to carry out the exposure to light to form an image. Consequently, the time during which the silver halide in the photographic material is exposed to light is the time required to expose a certain minute-area to light. As this minute-area, the minimum unit for which the amount of light from each digital data is controlled is used and is called a picture element. Therefore, depending on the size of the picture element, the exposure time per picture element changes. The size of the picture element depends on the picture element density, and ranges from 50 to 2,000 dpi in actuality. When the exposure time is defined as the time required for exposing a picture image size to light assuming the picture element density to be 400 dpi, the exposure time is preferably $10^{-4}$ sec to $10^{-10}$ sec, more preferably $10^{-6}$ sec to $10^{-10}$ sec.

In the photographic material of the present invention, preferably, for the purpose, for example, of preventing irradiation or halation or improving safelight immunity, to the hydrophilic colloid layer are added dyes that are described in European Patent No. 0337490A2, pages 27 to 76, and these dyes can be decolored by processing (e.g., an oxonol dye and a cyanine dye). Dyes to be incorporated in a hydrophilic colloid layer in the state of dispersed solid fine particles and are decolored by development processing, described in JP-A No. 282244/1990, page 3, the right upper column, to page 8, and also described in JP-A No. 7931/1991, page 3, the right upper column, to page 11, the left lower column, can be preferably used. When these dyes are used, preferably dyes are selected and used which have absorption overlapping with the spectral sensitivity maximum of the longest-wavelength photosensitive layer. Preferably, using these dyes, the optical exposure (the logarithm of the reciprocal of the transmitted light) (the reflection density in the case of a reflective base) in the laser wavelength of the particular photographic material is made to be 0.5 or more with a view to improving sharpness.

Some of these water-soluble dyes deteriorate the color separation if the amount of them to be used is increased. As dyes that can be used without deteriorating the color separation, water-soluble dyes described in Japanese patent application Nos. 310143/1991, 310189/1991, and 310139/1991 are preferred.

To improve the sharpness further, it is preferable to incorporate, into the water-resistant resin layer of the base, 12 wt % or more (more preferably 14 wt % or more) of titanium oxide, whose surface has been treated with a dihydric to tetrahydric alcohol (e.g., trimethylolmethane). It is also preferable to use colloidal silver in the antihalation layer as described in JP-A No. 239544/1989.

In the photographic material of the present invention, together with the coupler, color image preservability-improving compounds, as described in European Patent No. 0,277,589A2, are preferably used, and these are particularly preferably used in combination with the cyan coupler used in the present invention, such as a pyrazolotriazole coupler.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

As a support to be used for the photographic material of the present invention, a transparent base is also preferably used. In this case, preferably an anti-halation layer is applied on the side of the support or on the under surface of the support.

The exposed photographic material may be subjected to conventional color processing, and in a case of a color photographic material of the present invention, after color development processing it is preferably bleached and fixed for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, those described in below-mentioned patent publications, particularly in European Patent No. 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column 6 to p. 12 lower left column line 5, and p. 12 lower right column 4 from the bottom to p. 13 | line p. 28 upper right column line 16 to p. 29 lower right column line 11 and line p. 30 lines 2 to 5 | p. 45 line 53 to p. 47 line 3 and p. 47 lines 20 to 22 |

-continued

| Element constituting photographic material | JP-A No. 215272/1987 | JP-A No. 33144/1990 | EP 0,355,660A2 |
|---|---|---|---|
| | upper left column line 17 | | |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Ptain inhibitor | p. 188 lower right column line 9 to p. 193 lower right column line 10 | p. 37 upper left column last line to lower right column line 13 | p. 65 line 32 to p. 66 line 1 |

-continued

| Element constituting photographic material | JP-A No. 215272/1987 | JP-A No. 33144/1990 | EP 0,355,660A2 |
|---|---|---|---|
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 21572/1987, amendment filed on March 16, 1987 is included.

Further, conventionally well known cyan couplers may be used in combination with the cyan coupler having a chemical structure represented formula (I) or (II). As these cyan couplers, diphenylimidazole cyan couplers described in JP-A No. 33144/1990, as well as 3-hydroxypyridine cyan dye-forming couplers described in European Patent No. 0,333,185A2 (in particular one obtained by causing Coupler (42), which is a four-equivalent coupler, to have a chlorine coupling split-off group, thereby rendering it to two-equivalent, and Couplers (6) and (9), which are listed as specific examples, are preferable) and cyclic active methylene cyan dye-forming couplers described in JP-A No. 32260/1990 (in particular, specifically listed Coupler Examples 3, 8, and 34 are preferable) are preferably used.

In the present invention, as the yellow dye-forming coupler (hereinafter referred to as yellow coupler), any yellow couplers described in the known literature in the above Table can be used and, among them, yellow couplers represented by the following formula (Y) are preferred:

formula (Y)

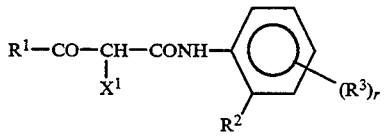

In formula (Y), $R^1$ represents a tertiary alkyl group or an aryl group, $R^2$ represents a hydrogen atom, a halogen atom (e.g., F, Cl, Br, and I, hereinafter the same being applied in the description of formula (Y)), an alkoxy group, an aryloxy group, an alkyl group, or a dialkylamino group, $R^3$ represents a group substitutable onto a benzene ring, $X^1$ represents a hydrogen atom or a group capable of being released upon coupling reaction with the oxidized product of an aromatic primary amine developing agent (coupling-off group), and r is an integer of 0 to 4, and when r is an integer of 2 to 4, $R^3$'s may be the same or different.

Examples of $R^3$ include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, and an arylsulfonyloxy group, and examples of the coupling-off group include a heterocyclic group bonded to the coupling active site through the nitrogen atom, an aryloxy group, an arylthio group, an acyloxy group, an alkylsulfonyl group, a heterocyclic-oxy group, and a halogen atom. When $R^1$ represents a tertiary alkyl group, it may contain a cyclic structure, such as cyclopropyl, cyclobutyl, cyclopentyl, and cyclohexyl.

In formula (Y), preferably, $R^1$ represents a t-butyl group, a 1-alkylcyclopropyl group, or a 1-alkylcyclopentyl group, $R^2$ represents a halogen atom, an alkyl group, an alkoxy group, or a phenoxy group, $R^3$ represents a halogen atom, an alkoxy group, an alkoxycarbonyl group, a carbonamido group, a carbamoyl group, or a sulfonamido group, X represents an aryloxy group or a 5- to 7-membered heterocyclic group bonded to the coupling active site through the nitrogen atom which may optionally further contain N, S, O, or P, and r is an integer of 0 to 2.

In formula (Y), when $R^1$ represents a 1-alkylcyclopropyl group or a 1-alkylcyclopentyl group, the alkyl group is an alkyl group having 1 to 18 carbon atoms, preferably a straight-chain alkyl group having 1 to 4 carbon atoms, and most preferably an ethyl group.

The coupler represented by formula (Y) may be a dimer or higher polymer bonded through a divalent or higher polyvalent group at the substituent $R_1$, X, or

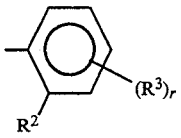

or a homopolymer or a copolymer containing non-color-forming polymerization units.

Specific examples of the coupler represented by formula (Y) are shown below:

(1)

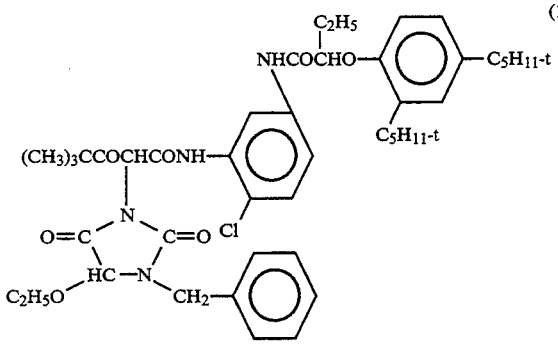

(2)

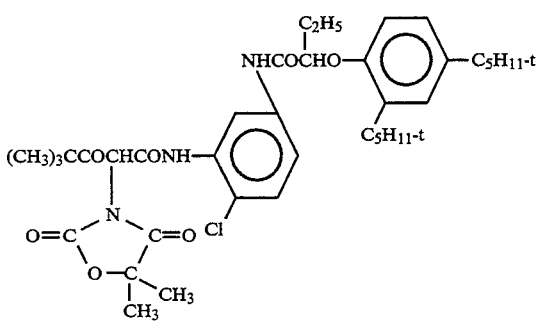

(3)

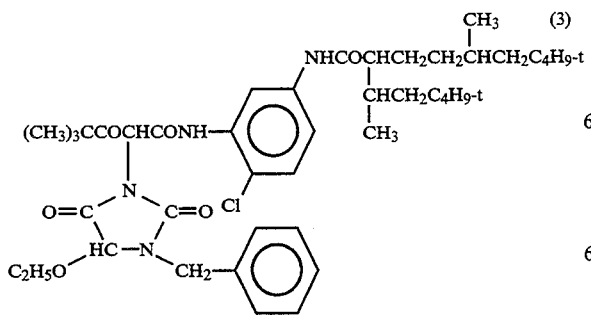

-continued (4)

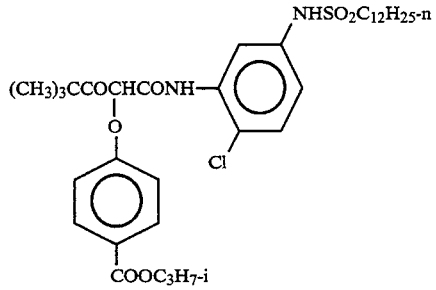

(5)

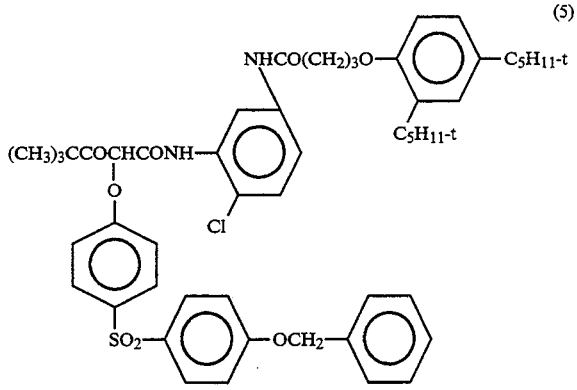

(6)

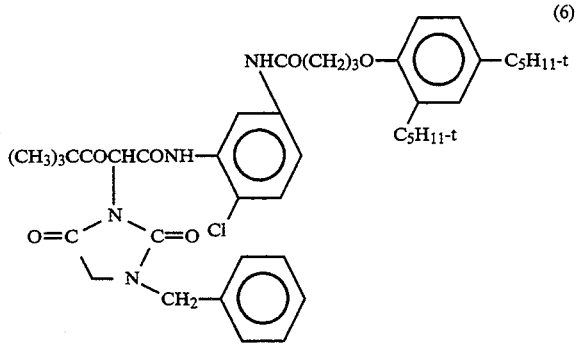

(7)

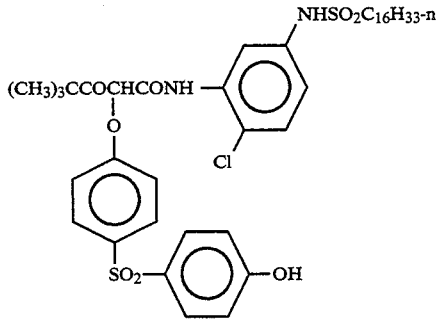

-continued
(8)
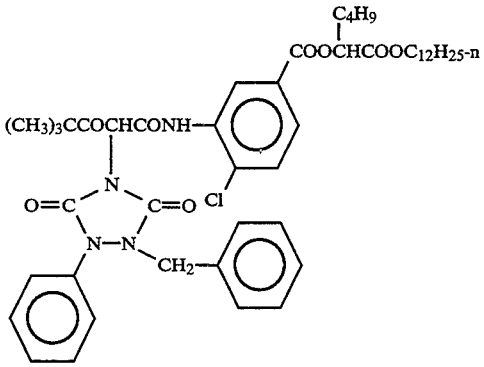
(9)
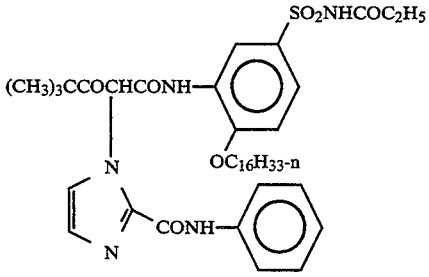
(10)
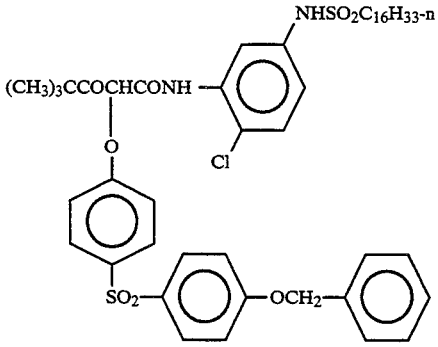
(11)
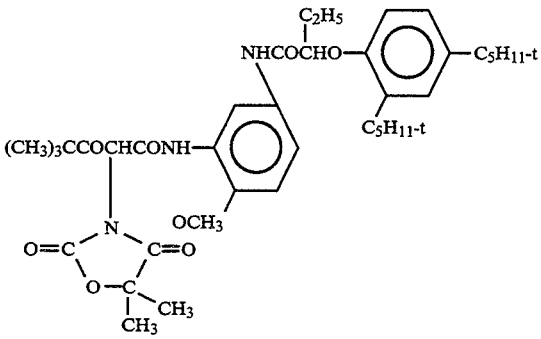
(12)
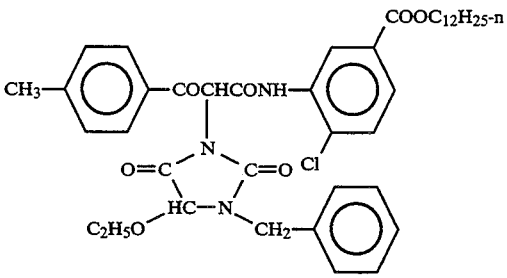
-continued
(13)
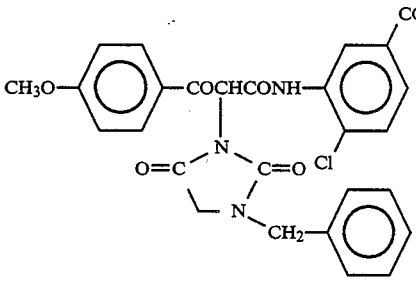
(14)
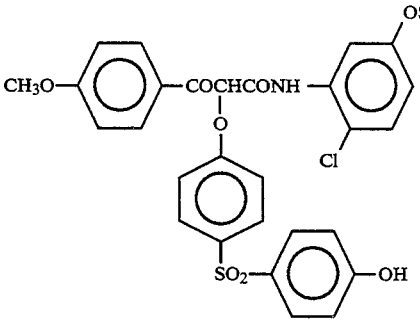
(15)
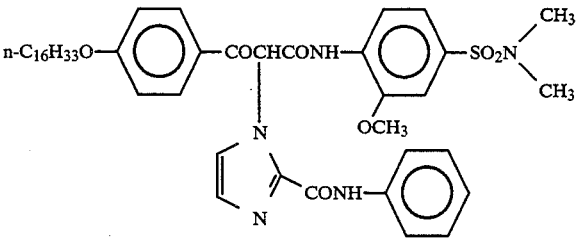
(16)
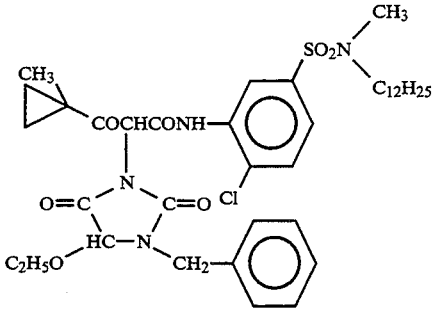
(17)
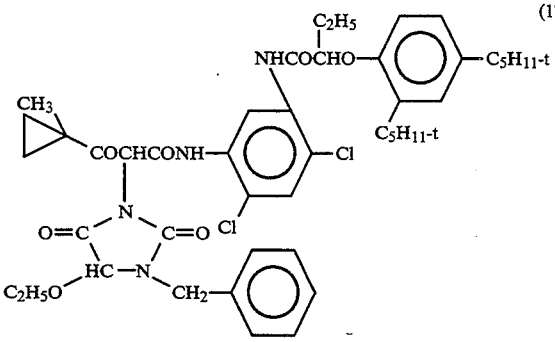

-continued (18)

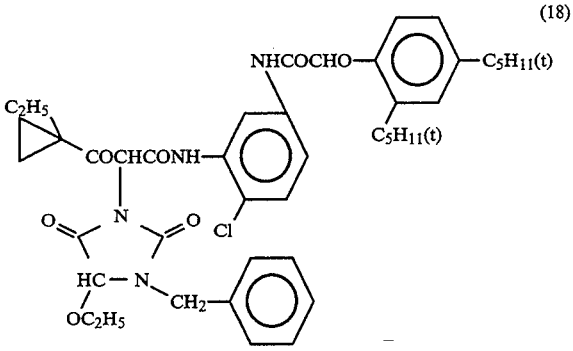

(19)

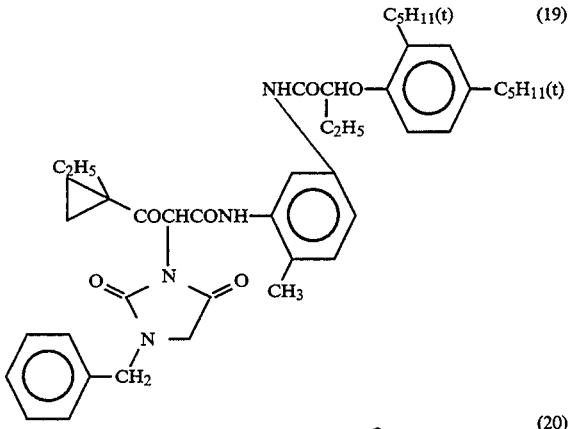

(20)

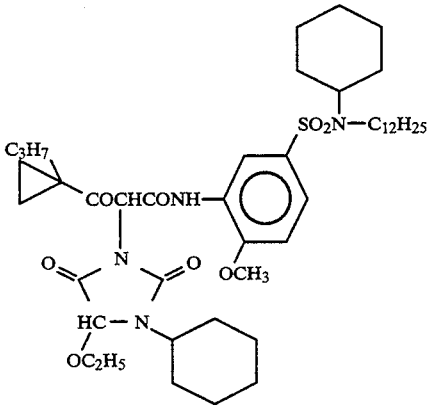

(21)

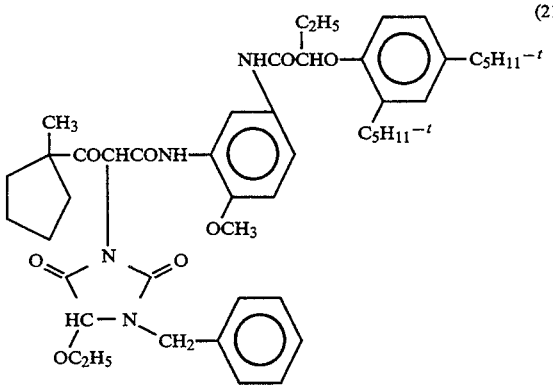

Compounds other than the above yellow couplers that can be used in the present invention and/or methods of synthesizing them are described, for example, in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, European Patent Nos. 30,747A, 284,081A, 296,793A, and 313,308 A, West German Patent No. 3,107,173 C, and JP-A Nos. 42044/1983, 174839/1984, 276547/1987, and 123047/1988.

As the magenta coupler to be used in the present invention, 5-pyrazolone magenta couplers and pyrazoloazole magenta couplers listed in the known literature in the above Table are used, and, among them, preferably pyrazolotriazole couplers wherein a secondary or tertiary alkyl group is bonded to the 2-, 3-, or 6-position of the pyrazolotriazole ring as described in JP-A No. 65245/1986, pyrazoloazole couplers having a sulfonamido group in the molecule as described in JP-A No. 65246/1986, pyrazoloazole couplers having an alkoxyphenylsulfonamido ballasting group as described in JP-A No. 147254/1986, and pyrazolotriazole couplers having an alkoxy group or an aryloxy group in the 6-position as described in European Patent Nos. 226,849A and 294,785A are used.

As the method for processing the color photographic material of the present invention, a method described in JP-A No. 207250/1990 is preferred.

The processing temperature of the color developer that can be applied to the present invention is 20° to 50° C., preferably 30° to 45° C. Preferably the processing time is substantially within 25 sec. The smaller the replenishing amount is, the more preferable it is, and the replenishing amount is suitably 20 to 600 ml, preferably 50 to 300 ml, more preferably 60 to 200 ml, and most preferably 60 to 150 ml, per square meter of the photographic material.

In the present invention, preferably the processing time is substantially within 25 sec and herein the expression "substantially within 25 sec" refers to the period from the time when the photographic material is introduced into the developer tank to the time when the photographic material enters the next tank, including the crossover time in the air during movement from the developer tank to the next tank.

In the present invention, the processing time of bleach-fixing step is preferably 5 to 25 sec, more preferably 10 to 20 sec, and the processing temperature is preferably 25° to 50° C., more preferably 35° to 45° C. The pH of the washing step or stabilizing step is preferably 4 to 10, more preferably 5 to 8. Although the temperature can be variously set depending, for example, on the application and properties of the photographic material, generally the temperature is 30° to 45° C., preferably 35° to 42° C. Although the time can be set arbitrarily, the shorter the time is, the more desirable it is in view of the reduction in the processing time. The time is preferably 10 to 45 sec, more preferably 10 to 40 sec. The smaller the replenishing amount is, the more preferable it is, for example, in view of the running cost, the reduction of the amount of discharge, and handleability.

A specific preferable replenishing amount is 0.5 to 50 times, preferably 2 to 25 times, the carried-in amount from the preceding bath per unit area of the photographic material, and this amount is 300 ml or below, preferably 150 ml or below, per square meter of the photographic material. The replenishing may be carried out continuously or intermittently.

The liquid used in the washing and/or stabilizing step can be used again for the preceding step. For example, the overflow of the washing water saved by a multistage countercurrent system is flowed into the preceding bleach-fix bath and a concentrated liquid is supplied to the bleach-fix bath, thereby reducing the amount of the waste liquor.

Now, the drying step usable in the present invention will be described.

The desired drying time is 20 to 40 sec in order to complete an image by the present super-rapid processing. As improving means of shortening the drying time, it is possible to decrease the amount of water that will be carried in by reducing the hydrophilic binder, such as gelatin, on the side of the photographic material. Also with a view to reducing the amount of the processing sclution that will be carried in, it is also possible that immediately after the emergence of the photographic material from the washing bath, the water may be absorbed by squeeze rolls or cloth, to quicken the drying. As improving means on the side of the dryer, it is indeed possible that, for example, the temperature may be increased or the drying current may be intensified to quicken the drying. Further, by adjusting the angle of the stream of the drying current to the photographic material or by the way of removing the discharged current, the drying can be quickened.

An embodiment of the present invention is described below with reference to the accompanying drawings, but the present invention is not limited to it.

FIG. 1 is a schematic diagram of the structure of an image-forming apparatus wherein a silver halide photographic color paper is used, illustrating an embodiment of the present invention. By the image-forming apparatus, a color paper is exposed to light, developed, bleach-fixed, washed, and then dried to form an image on the color paper. The color paper (hereinafter referred to as photographic material) used by the image-forming apparatus is a color photographic material having on a support at least one layer of a silver halide emulsion containing 95 mol % of silver chloride, and it is color-developed with a color-developer containing an aromatic primary amine color developing agent.

In the image-forming apparatus body 10, an exposure apparatus 300, a developing tank 12, a bleach-fix tank 14, washing tanks 16, a draining section 17, and a drying section 18 are provided successively, and a photographic material 20 that has been exposed to light is developed, bleach-fixed, washed with water, dried, and then discharged from the body 10. The developing tank 12, the bleach-fix tank 14, the washing tanks 16, the draining section 17, and the drying section 18 are provided with conveying roller pairs 24 for conveying the photographic material 20 through the processing sections with the photographic material 20 pinched between rollers. The conveying roller pairs 24 in the draining section 17 also serve as water-removing rollers, having a function of removing water droplets on the photographic material 20 by squeezing, absorbing, etc. While the photographic material 20 is pinched and conveyed by the conveying roller pairs 24 with the emulsion surface down, the photographic material 20 is dipped in each processing solution for a prescribed time to be color-developed. Each of the developing tank 12, the bleach-fix tank 14, and the washing tanks 16 is provided with a processing-solution-jetting member 30, at a prescribed position for powerfully jetting the processing solution, to create a high-speed jet in the processing tank. Each of the developing tank 12, the bleach-fix tank 14, and the washing tanks 16 is provided with a pump 32, and each processing solution is circulated by the pump 32 and is jetted out through the processing-solution-jetting member 30 toward the photographic material 20.

Figure 2:
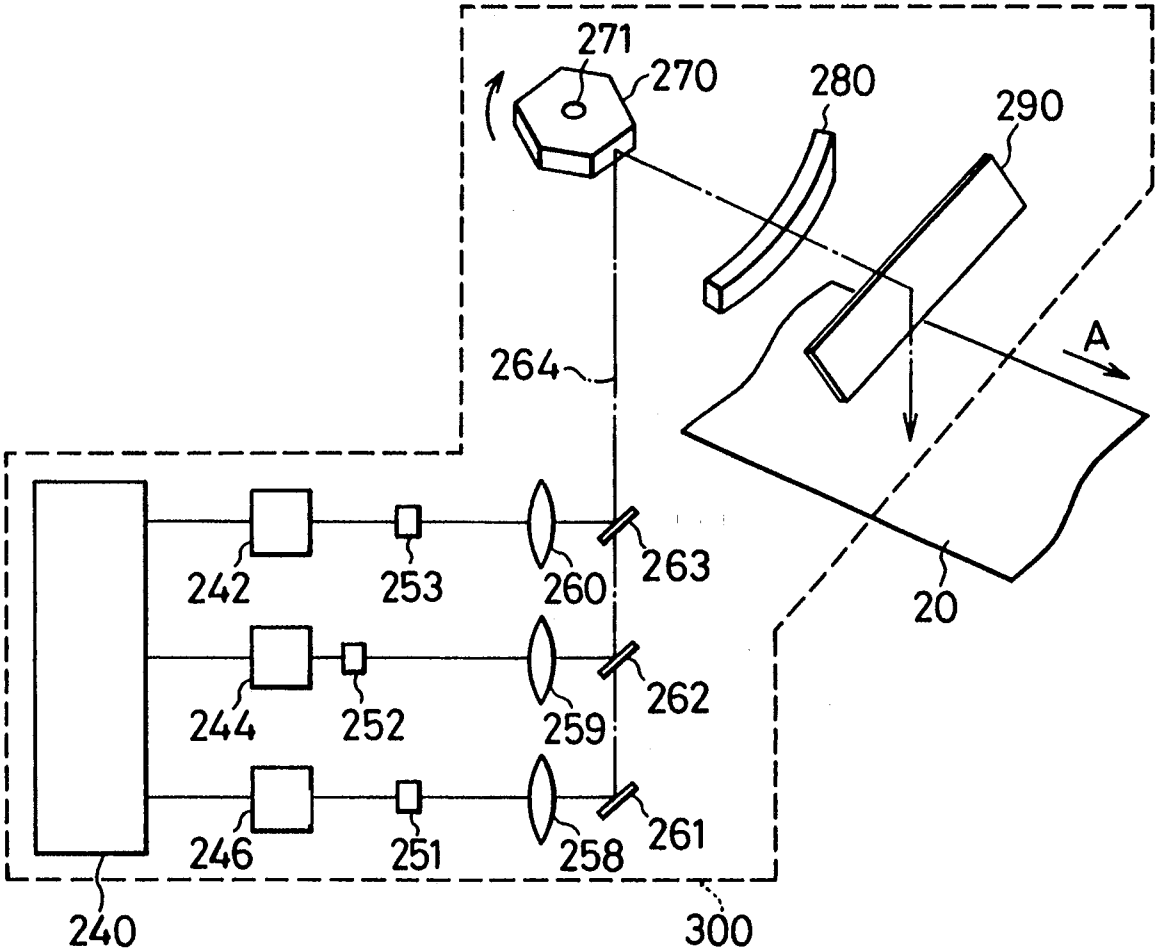
FIG. 2 is a schematic diagram of the structure of the exposure apparatus to use in the method for forming a color image of the present invention.

FIG. 2 is a diagram of the structure of the exposure apparatus 300.

The exposure apparatus 300 emits a set of three color lights to expose the photographic material 20 to the set of lights. In the exposure apparatus 300, based on the image data processed by an image-processing apparatus 240 connected to a computer or the like, drivers 242, 244, and 246 drive semiconductor lasers 251, 252, and 253 to expose the photographic material to the lights. In the exposure apparatus 300, the light for forming magenta is formed by the semiconductor laser 251 for jetting a laser light having a wavelength of 750 nm. The semiconductor laser 251 is, for example, LTO30MF, manufactured by Sharp Corporation (KK). The laser light having a wavelength of 750 nm jetted from the semiconductor laser 251 is passed through a collimator lens 258, to be collimated, and is reflected by a total reflection mirror 261, toward a polygonal mirror 270. The light for forming cyan is formed by the semiconductor laser 252 for jetting a laser light having a wavelength of 830 nm. The laser light having a wavelength of 830 nm jetted from the semiconductor laser 252 is passed through a collimator lens 259, to be collimated, and is reflected by a dichroic mirror 262, which permits light for forming magenta to transmit and which reflects light for forming cyan, toward the polygonal mirror 270. The semiconductor laser 252 is, for example, TOLD152R, manufactured by Toshiba (KK), or LTO10MF, manufactured by Sharp Corporation (KK). The light for forming yellow is formed by the semiconductor laser 253 for jetting a laser light having a wavelength of 670 nm. The semiconductor laser 253 is, for example, TODL9200, manufactured by Toshiba (KK), NDL 3200, manufactured by Nippon Electric Co., Ltd., or SLD 151 U, manufactured by Sony Corporation (KK). The laser light having a wavelength of 670 nm jetted from the semiconductor laser 253 is passed through a collimator lens 260, to be collimated, and is reflected by a dichroic mirror 263, which allows light for forming magenta and light for forming cyan to transmit and which reflects light for forming yellow, toward the polygonal mirror 270. The above lights for forming cyan, magenta, and yellow travel one optical path 264; they are reflected by the polygonal mirror 270; they pass through an fΘ lens 280, and are then reflected by a mirror 290 to reach the photosensitive material 20. By rotating the polygonal mirror 270 about its axis 271, the image light scans the photographic material 20 to be exposed to the light. The photographic material 20 is moved in the direction (indicated by an arrow A) orthogonal to the scanning direction of the laser light, so that subscanning may be carried out to form an image. Here, the speed of the movement of the photographic material 20 during the exposure is equal to the speed of the movement during the development process, and the exposed part of the photographic material 20 is started to be developed after passage of the equivalent period.

Although the above exposure apparatus 300 is constituted such that the photographic material 20 is exposed to light based on image information processed by a computer or the like, it is also possible that the photographic material 20 may be exposed to light based on image information obtained by reading a manuscript.

According to the method for forming color image of the present invention, an excellent effect can be attained to provide rapidly and inexpensively a hard copy which has high image quality and which is improved in the change of photographic properties due to a change of development processing.

Next, the present invention will be described in detail in accordance with examples, but the invention is not limited to them.

EXAMPLE 1

Preparation of Photographic Material Sample 101

A multilayer color print paper (101) having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzenesulfonate. Coating solutions were prepared as follows:

Preparation of the First Layer Coating Solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl acetate, and the resulting solution was dispersed and emulsified in 1,000 ml of 10% aqueous gelatin solution containing 60 ml of 10% sodium dodecylbenzenesulfonate solution and 10 g of citric acid, thereby prepared emulsified dispersion A. Separately silver chlorobromide emulsion A (cubic grains, 3:7 (silver mol ratio) blend of large size emulsion having 0.88 μm of average grain size and small size emulsion having 0.70 μm of average grain size, and 0.08 and 0.10 of deviation coefficient of grain size distribution, respectively, each in which 0.3 mol % of silver bromide was located at a part of grain surface) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively. The chemical ripening of this emulsion was carried out optimumly by adding sulfur sensitizing agent (triethyl thiourea) and gold sensitizing agent (chloroauric acid) in the presence of nucleic acid (containing decomposed product). The above-described emulsified dispersion A and this silver chlorobromide emulsion A were mixed together and dissolved to give the composition shown below, thereby preparing the first layer coating solution.

Preparation of the Fifth Layer Coating Solution 50.0 Grams of cyan coupler (ExC), 53.0 g of image-dye stabilizer (Cpd-1), 4.5 g of image-dye stabilizer (Cpd-2), 23.0 g of image-dye stabilizer (Cpd-5), 1.5 g of image-dye stabilizer (Cpd-6), 1.5 g of image-dye stabilizer (Cpd-7), 12.0 g of image-dye stabilizer (Cpd-8), 23.0 g of image-dye stabilizer (Cpd-9), 23.0 g of image-dye stabilizer (Cpd-10), and 1.5 g of image-dye stabilizer (Cpd-11) were dissolved in 1.5 g of solvent (Solv-1), 33 g of solvent (Solv-6), and 100 ml of ethyl acetate, and the resulting solution was dispersed and emulsified in 1,000 ml of 10% aqueous gelatin solution containing 60 ml of 10% sodium dodecylbenzenesulfonate solution and 10 g of citric acid, thereby prepared emulsified dispersion C. Separately silver chlorobromide emulsion C (cubic grains, 1:4 (silver mol ratio) blend of large size emulsion having 0.50 μm of average grain size and small size emulsion having 0.41 μm of average grain size, and 0.09 and 0.11 of deviation coefficient of grain size distribution, respectively, each in which 0.8 mol % of silver bromide was located at a part of grain surface, and at the inner side of grains and in the silver bromide localized layer 0.5 mg of potassium hexachloroiridate (IV) and 2.5 mg of potassium ferrocyanide, each in total amount, were contained) was prepared. After sensitizing dye E and compounds, shown below, were added to the large size emulsion and small size emulsion, in each amount shown below, the chemical ripening of this emulsion was carried out optimumly by adding same sulfur sensitizing agent and same gold sensitizing agent, as those used in the first layer, in the presence of nucleic acid (containing decomposed product). The above-described emulsified dispersion C and this silver chlorobromide emulsion C were mixed together and dissolved to give the composition shown below, thereby preparing the fifth layer coating solution.

Coating solutions for the second to fourth, and sixth and seventh layers were also prepared in the same manner as above described. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 mg/m$^2$ and 50.0 mg/m$^2$.

Silver chlorobromide emulsion in each photosensitive emulsion layer was controlled in size of grains in the same manner as the above described silver chlorobromide emulsion A, and spectral sensitizing dyes shown below were used in respective layers.

Blue-sensitive emulsion layer:

Sensitizing dye A

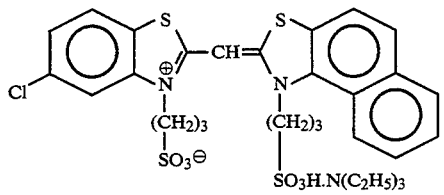

and

Sensitizing dye B

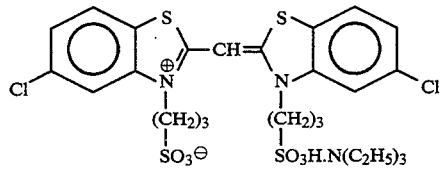

(each $2.0\times10^{-4}$ mol to the large size emulsion and $2.5\times10^{-4}$ mol to the small size emulsion, per mol of silver halide. )

Green-sensitive emulsion layer:

Sensitizing dye C

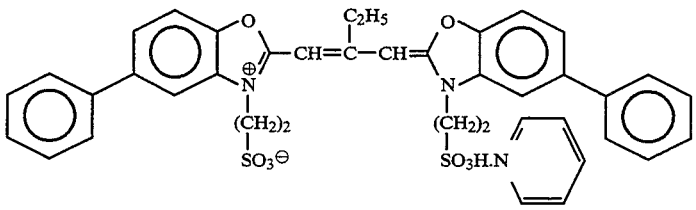

($4.0\times10^{-4}$ mol to the large size emulsion and $5.6\times10^{-4}$ mol to the small size emulsion, per mol of silver halide)

and

Sensitizing dye D

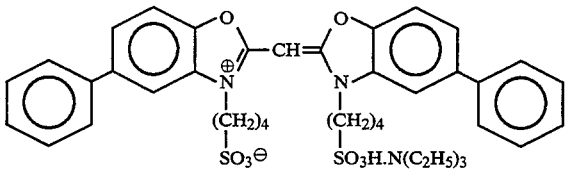

($7.0\times10^{-5}$ mol to the large size emulsion and $1.0\times10^{-5}$ mol to the small size emulsion, per mol of silver halide)

Red-sensitive emulsion layer:

Sensitizing dye E

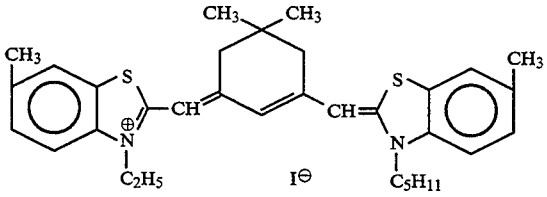

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

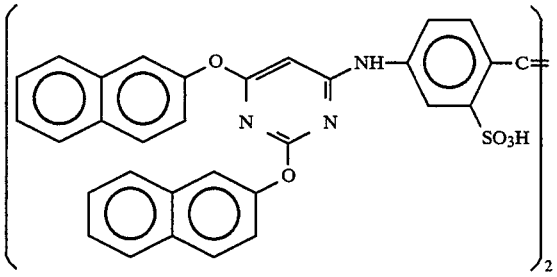

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7 -tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

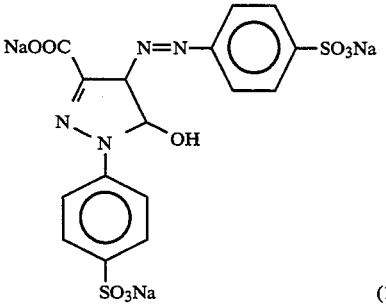

(10 mg/m²)

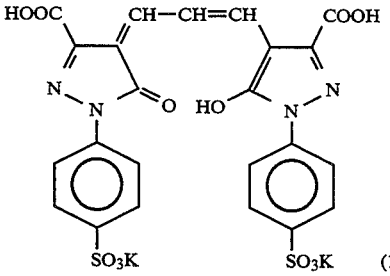

(10 mg/m²)

-continued

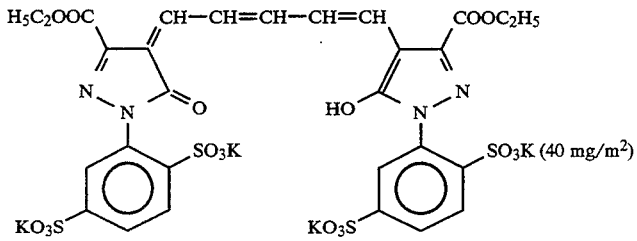

and

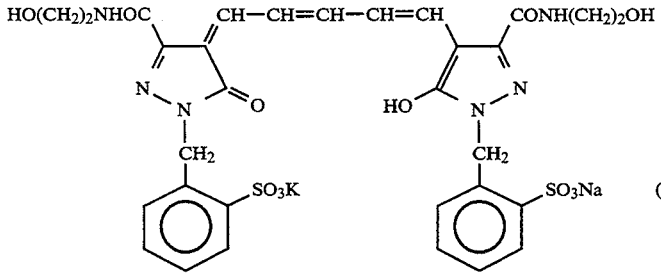

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer) | |
| The above described silver chlorobromide emulsion A | 0.27 |
| Gelatin | 1.22 |
| Yellow coupler (ExY) | 0.79 |
| Image-dye stabilizer (Cpd-1) | 0.08 |
| Image-dye stabilizer (Cpd-2) | 0.04 |
| Image-dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 0.90 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsion B (cubic grains, 1:3 (Ag mol ratio) blend of large size emulsion having average grain size of 0.55 μm and small size emulsion having average grain size of 0.39 μm, whose deviation coefficient of grain size distribution is 0.10 and 0.08, respectively, each in which emulsion 0.8 mol % of silver bromide was located at a part of grain surface, and at the inner side of grains and in the silver bromide-localized layer 0.5 mg of potassium hexachloroiridate (IV) and 2 mg of potassium ferrocyanide, each in total amount, were contained) | 0.13 |
| Gelatin | 1.28 |
| Magenta coupler (ExM) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion C (cubic grains, 1:4 (Ag mol ratio) blend of large size emulsion C having average grain size of 0.50 μm and small size emulsion C having average grain size of 0.41 μm, whose deviation coefficient of grain size distribution is 0.09 | 0.18 |

-continued

| | |
|---|---|
| and 0.11, respectively, each in which emulsion 0.8 mol % of silver bromide was located at a part of grain surface, and at the inner side of grains and in the silver bromide-localized layer 0.5 mg of potassium hexachloroiridate (IV) and 2.5 mg of potassium ferrocyanide, each in total amount, were contained) | |
| Gelatin | 0.80 |
| Cyan coupler (ExC) | 0.33 |
| Ultraviolet absorber (UV-2) | 0.18 |
| Image-dye stabilizer (Cpd-1) | 0.35 |
| Image-dye stabilizer (Cpd-2) | 0.03 |
| Image-dye stabilizer (Cpd-5) | 0.15 |
| Image-dye stabilizer (Cpd-6) | 0.01 |
| Image-dye stabilizer (Cpd-7) | 0.01 |
| Image-dye stabilizer (Cpd-8) | 0.08 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-1) | 0.01 |
| Solvent (Solv-6) | 0.22 |
| Sixth Layer (Ultraviolet absorbing Layer) | |
| Gelatin | 0.48 |
| Ultraviolet absorber (UV-1) | 0.38 |
| Image-dye stabilizer (Cpd-5) | 0.02 |
| Image-dye stabilizer (Cpd-12) | 0.15 |
| Solvent (Solv-5) | 0.08 |
| Seventh Layer (Protective layer) | |
| Gelatin | 1.10 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used are as follows:

(ExY) Yellow coupler

Mixture ((a):(b) = 1:1 in molar ratio) of (a) R = 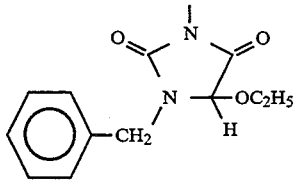 , X = Cl;

and (b) R = 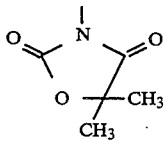 , X = $OCH_3$ of the following formula

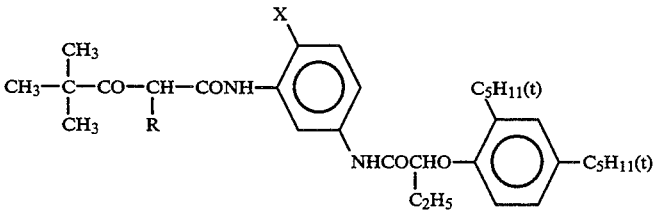

(ExM) Magenta coupler

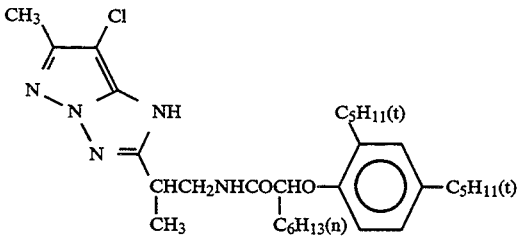

-continued
(ExC) Cyan coupler
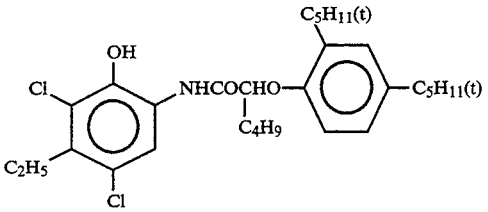
(Cpd-1) Image-dye stabilizer
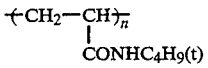
Av. molecular weight: 60,000
(Cpd-2) Image-dye stabilizer
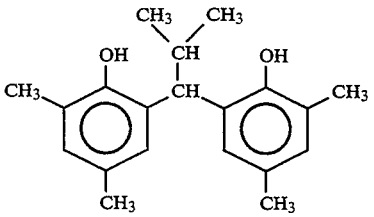
(Cpd-3) Image-dye stabilizer
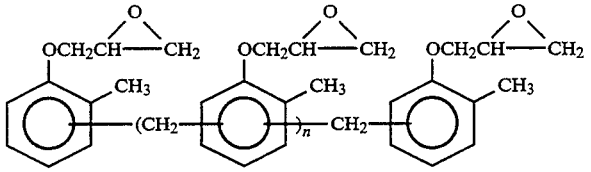
n = 7–8 (in average)
(Cpd-4) Image-dye stabilizer
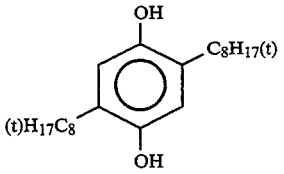
(Cpd-5) Image-dye stabilizer
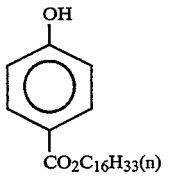
(Cpd-6) Image-dye stabilizer
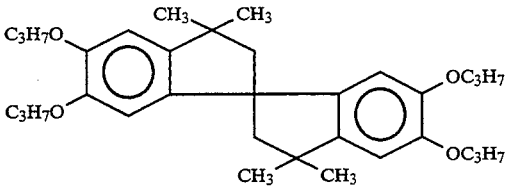
(Cpd-7) Image-dye stabilizer
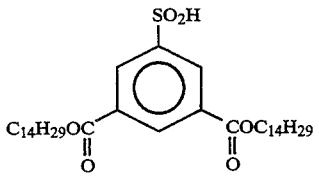
(Cpd-8) Image-dye stabilizer
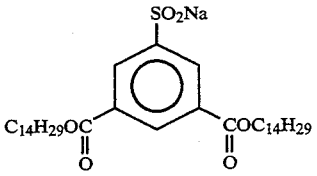
(Cpd-9) Image-dye stabilizer
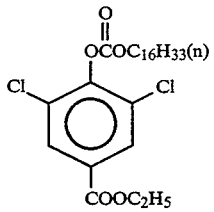
(Cpd-10) Image-dye stabilizer
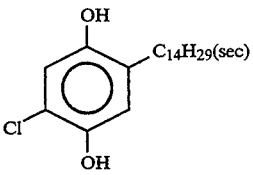

-continued
(Cpd-11) Image-dye stabilizer
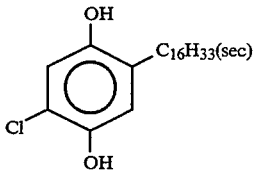
(Cpd-12)
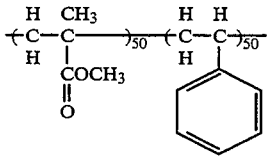
Av. molecular weight: 60,000
(Cpd-13)
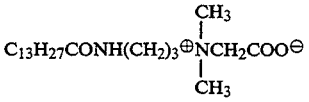
(Cpd-14) Antiseptic
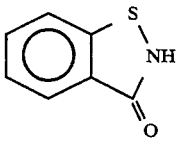
(Cpd-15) Antiseptic
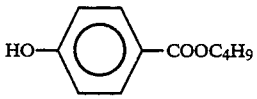
(UV-1) Ultraviolet ray absorber
Mixture of (i), (ii), (iii), and (iv) (10:5:1:5)
(i)
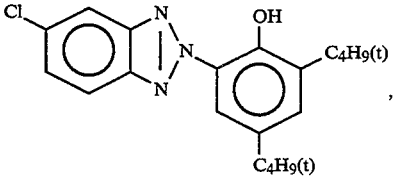
(ii)
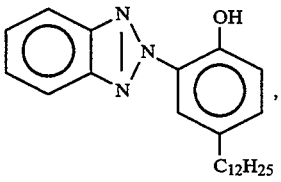
(iii)
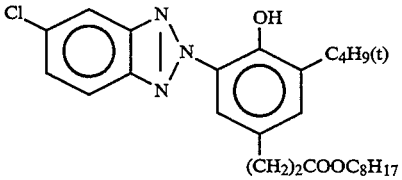
and
(iv)
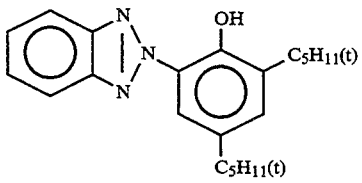
(UV-2) Ultraviolet ray absorber
Mixture of (v), (vi), and (vii) (1:2:2 in weight ratio)
(v)
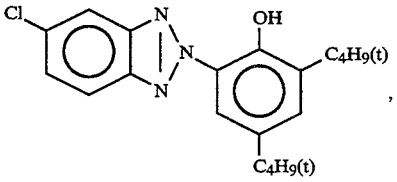
(vi)
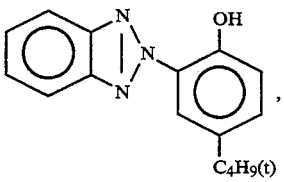
and
(vii)
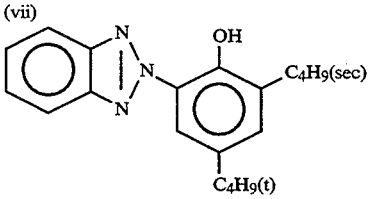

-continued (Solv-1) Solvent

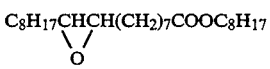

(Solv-2) Solvent

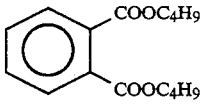

(Solv-3) Solvent

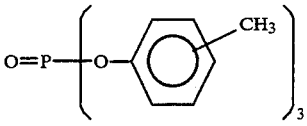

(Solv-4) Solvent

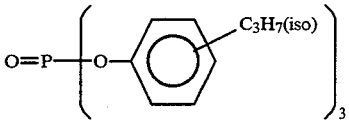

(Solv-5) Solvent

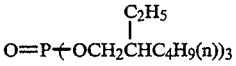

(Solv-6) Solvent

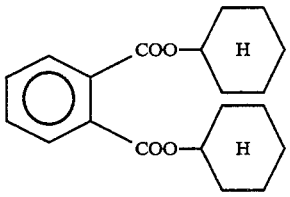

(Solv-7) Solvent

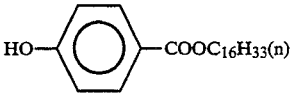

Photographic materials 102 to 108 having the similar composition to photographic material 101 were prepared by preparing emulsions of cyan coupler in the same emulsifying method as cyan coupler in the fifth layer (red-sensitive emulsion layer) of Photographic material 101, except that cyan coupler and its amount added were changed as shown the following Table, respectively. The amount of cyan coupler to be added in the samples of this invention was set so that the color density obtained is equal to that of comparative samples. Same was applied to the following Examples.

| Photographic Material | Cyan Coupler used in the 5th layer | | Remarks |
|---|---|---|---|
| | Coupler | Amount used (g/m$^2$) | |
| 101 | ExC | 0.33 | Comparison |
| 102 | ExC-2 | 0.33 | " |
| 103 | ExC-3 | 0.33 | " |
| 104 | C-1 | 0.17 | This Invention |
| 105 | C-2 | 0.17 | " |
| 106 | C-19 | 0.17 | " |
| 107 | C-36 | 0.17 | " |
| 108 | C-52 | 0.17 | " |

Comparative Cyan Coupler

ExC-2

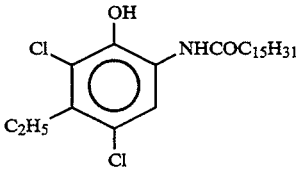

ExC-3

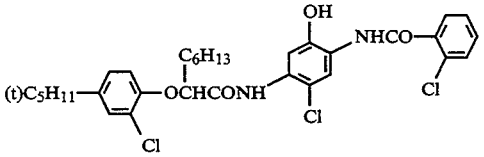

The prepared photographic material was exposed to light in the following two ways.

(1) Scanning Exposure

As the light source, 473 nm, obtained by taking a laser light of 946 nm that is a combination of a semiconductor laser GaAlAs (the emitting wavelength: about 830 nm) with a YAG solid state laser and wave-changing by an SHG device of $KNbO_3$, 532 nm obtained by taking a laser light of 1064 nm that is a combination of a semiconductor laser GaAlAs (the emitting wavelength: about 830 nm) with a $YVO_4$ solid state laser and wave-changing by an SHG device of KTP, and AlGaInP (the emitting wavelength: about 670 nm; Type No. TOLD9211 manufactured by Toshiba) were used. The apparatus was constituted such that by a rotating polygon the laser lights could traverse color paper moving in the direction orthogonal to the scanning direction, to carry out successively the exposure of the color paper to the lights. By using this apparatus, the amounts of lights were changed and the relationship D-log E between the density (D) of the photographic material and the amount of the light (E) was determined. The amounts of the laser lights of 473 nm and 532 nm taken through the SHG were modulated by external modulators, thereby changing the exposure quantities. The amount of light of the 670 nm semiconductor laser for exposure was controlled by a combination of a pulse width modulating system, for modulating the amount of light by changing the time of electricity supply to the semiconductor laser, with an intensity modulating system, for modulating the amount of light by changing the amount of electricity supply. The scanning exposure was carried out with the picture element density being 400 dpi, and at that time the average exposure time per picture element was about $10^{-7}$ sec. The temperature of the semiconductor lasers was kept constant by using Peltier devices, so that the amounts of lights might be kept from changing by the temperature.

(2) Plane Exposure

Using a sensitometer (FWH type, manufactured by Fuji Photo Film Co., Ltd.; the color temperature of the light source: 3,200 K.) and interference filters of 470 nm, 535 nm, and 670 nm, monochromatic lights were taken out and gradation exposure was given to the photographic material through a gradation wedge for sensitometry. At that time, the exposure to light was carried out such that the amount of exposure per sec of the exposure time was 2,500 CMS.

One of the samples exposed to light was processed in the following steps by a paper processor with a freshly prepared color developer, to prepare Sample (a), and the other was processed in the same steps by the paper processor with color developer that had been used continuously (running) until the replenishing amount reached twice the volume of the tank, to prepare Sample (b).

The reciprocal number of the logarithm of the amount of light required to give 1.0 to the cyan density of the red-sensitive layer of the obtained Samples (a) and (b) was determined, to find sensitivities Sc (1−(a)) (the sensitivity of the sample obtained by subjecting to the exposure (1) and to the processing (a)), Sc (1−(b)), Sc (2−(a)), and Sc (2-(b)). The differences of the sensitivities:

$$\Delta S1=[Sc\ (1-(b))-Sc\ (1-(a))]$$

and $$\Delta S2=[Sc\ (2-(b))-Sc\ (2-(a))]$$

were used as scales of the change of the sensitivity of the red-sensitive layer caused by a change in the processing solution at the time when scanning exposure and plane exposure were carried out.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material.
Rinsing steps were carried out in 3-tanks countercurrent mode from the tank of rinsing (3) toward the tank of rinsing (1).

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl) hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate | 55 g | |
| Disodium ethylenediaminetetraacetate | 5 g | |
| Ammonium bromide | 40 g | |
| Water to make | 1000 ml | |
| pH (25° C.) | 6.0 | |
| Rinse solution (Both tank solution and replenisher) | | |
| Ion-exchanged water (calcium and magnesium each are 3 ppm or below) | | |

Results obtained are shown in Table 2.

TABLE 2

| Photographic Material | Change in Sensitivity of Cyan Color-forming Layer due to Change of Processing Solution: ΔS1 (Scanning Exposure) | ΔS2 (Plane Exposure) | Remarks |
|---|---|---|---|
| 101 | −0.07 | −0.03 | Comparison |
| 102 | −0.09 | −0.04 | Comparison |
| 103 | −0.08 | −0.03 | Comparison |
| 104 | −0.04 | −0.03 | This Invention |
| 105 | −0.03 | −0.02 | This Invention |
| 106 | −0.03 | −0.03 | This Invention |
| 107 | −0.03 | −0.02 | This Invention |
| 108 | −0.04 | −0.03 | This Invention |

Note;
S1 = [Sc(1-(b))-Sc(1-(a))]
S2 = [Sc(2-(b))-Sc(2-(a))]

From the obtained results, it can be understood that, in the case of the photographic materials 104 to 108 wherein the present cyan couplers were used in the red-sensitive layers, the change in sensitivity of the red-sensitive layer due to a change of a processing solution is small in comparison with the cases of the photographic materials 101 to 103, wherein comparative cyan couplers were used. Further, this effect is remarkable in scanning exposure, that is, in high-intensity short-period exposure.

EXAMPLE 2

Preparation of Emulsion a 3.3 Grams of sodium chloride and 24 ml of 1N sulfuric acid were added to a 3% aqueous lime-processed gelatin solution, and then 3.2 ml of N,N'-dimethylimidazolidine-2-thion (a 2% aqueous solution) was added. To this aqueous solution were added an aqueous solution containing 0.2 mol of silver nitrate and an aqueous solution containing 0.2 mol of sodium chloride and 15 μg of rhodium trichloride, at 56° C. with vigorous stirring. Then, an aqueous solution containing 0.79 mol of silver nitrate and an aqueous solution containing 0.79 mol of sodium chloride and 4.2 mg of potassium ferrocyanide were added thereto at 56° C. with violent stirring. After 5 min of the completion of the addition of the aqueous silver nitrate solution and the aqueous halogenated alkali solution, $2\times10^{-4}$ mol of (Dye-F) was added, at 50° C., and then, after 15 min, silver bromide fine grains (the grain size: 0.05 μm) in an amount of 0.01 mol in terms of silver nitrate, and an aqueous solution containing potassium hexachloroiridate(IV) in an amount of 0.8 mg, were added, with vigorous stirring. Thereafter, a copolymer of isobutene/monosodium maleate was added, to allow sedimentation to take place and washing with water was carried out, to effect desalting. Further, 90.0 g of lime-processed gelatin was added, and the pH and pAG of the emulsion were adjusted to 6.2 and 6.5, respectively. Further, $1\times10^{-5}$ mol of a sulfur sensitizer (triethyl thiourea)/mol of Ag, $1\times10^{-5}$ mol of chloroplatinic acid/mol of Ag, and 0.2 mol of nucleic acids (including degradation products)-/mol of Ag were added, to optimally chemically sensitize the emulsion at 50° C.

With respect to the obtained silver bromochloride grains a, the shape of the grains, the grain size, and the grain size distribution were determined from an electron micrograph thereof. These silver halide grains were cubic; the grain size was 0.52 μm; and the deviation coefficient was 0.08. The grain size was represented by the average value of the diameters of the circles equivalent to the projected areas of the grains, and the deviation coefficient was represented by the value obtained by dividing the standard deviation by the average grain size.

Then, the X-ray diffraction from the silver halide crystals was measured, to determine the halogen composition of the emulsion grains. A monochromatized CuKα ray was used as a radiation source to measure the angle of diffraction from the (200) plane. While the diffraction line from a crystal uniform in halogen composition gives a single peak, the diffraction line from a crystal having localized phases different in composition gives peaks whose number corresponds to the number of the compositions. By calculating the lattice constant from the angle of diffraction of the measured peak, the halogen composition of the silver halide constituting the crystal can be determined. From the results of the measurement of the silver chlorobromide emulsion, a broad diffraction pattern having, as a center, besides the main peak of 100% silver chloride, 70% silver chloride (30% silver bromide) with a base spreading near to 60% silver chloride (40% silver bromide), was observed.

Preparation of Emulsions b and c

The procedure for the preparation of the emulsion a was repeated, except that, instead of (Dye-F), (Dye-G) in an amount of $4\times10^{-5}$ mol, and (Dye-H) in an amount of $2\times10^{-5}$ mol, were used, thereby preparing emulsions b and c, respectively.

(Dye-F)

Mixture (1:1 in molar ratio) of

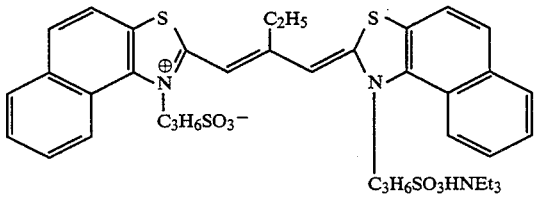

and

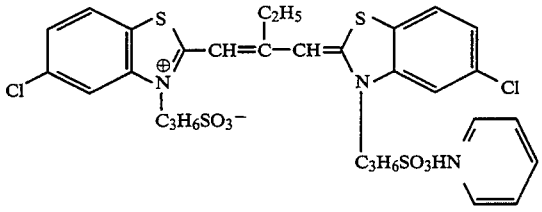

(Dye-G)

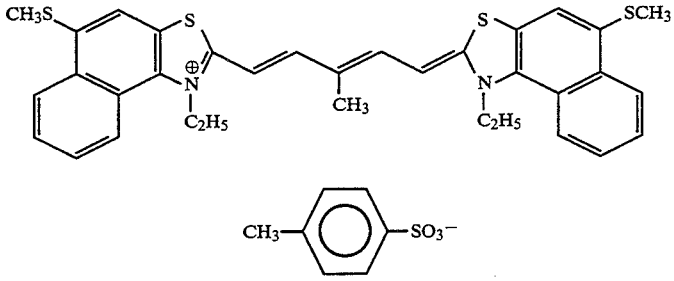

(Dye-H)

-continued

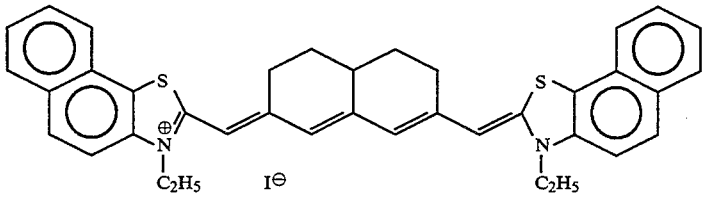

To the emulsions a, b, and c was added 1-(5-methylureidophenyl)-5-mercaptotetrazole in an amount of $5.0\times10^{-4}$ mol, per mol of the silver chloride.

Further, to the emulsions b and c, (Cpd-16) and (Cpd-17) were added, respectively, in amounts $3\times10^{-3}$ mol and $1\times10^{-3}$ mol, respectively.

(Cpd-16)

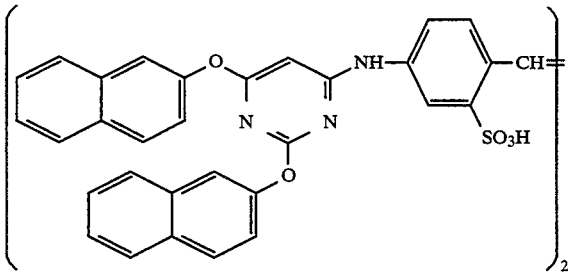

-continued

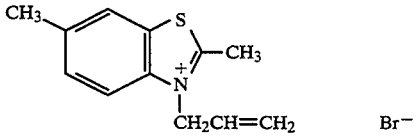

(Cpd-17)

Preparation of Photographic Material 201

Photographic material 201 was prepared in the same manner as photographic material 101, except that, instead of the emulsions A, B, and C used in the first, third, and fifth layers of the photographic material 101, the emulsion a, the emulsion b, and the emulsion c were used in the first layer, the third layer, and the fifth layer, respectively, and, instead of the antiirradiation dye used in Example 1, the dye shown below was used.

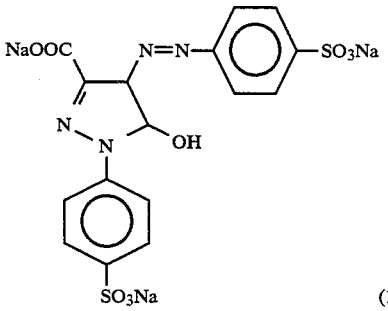

(10 mg/m²)

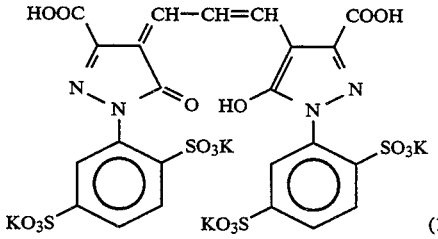

(10 mg/m²)

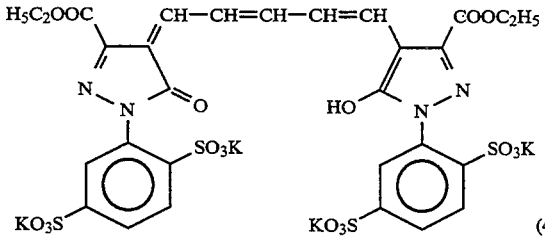

(40 mg/m²)

and

-continued

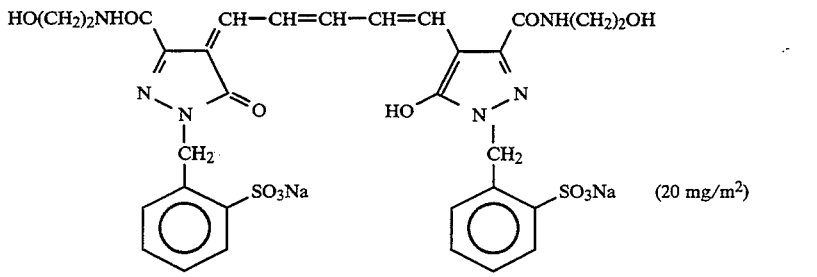

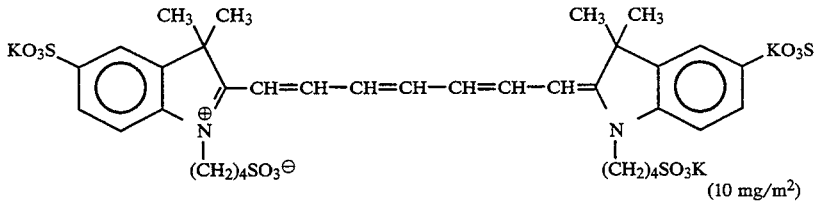

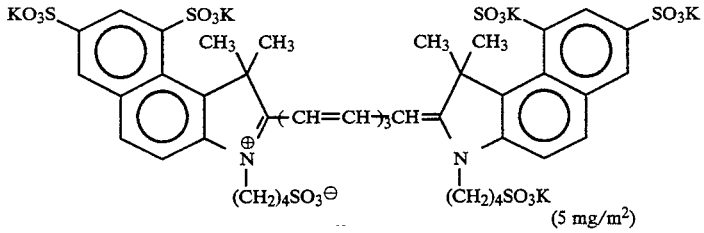

and

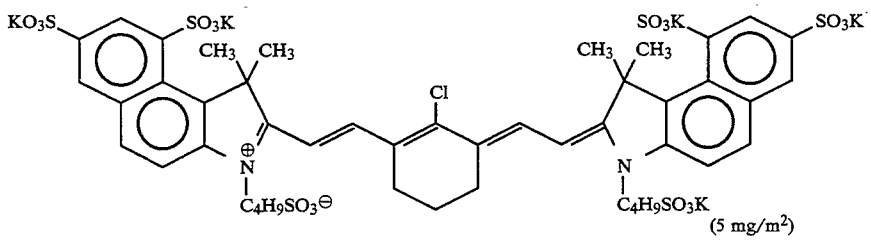

This photographic material was made up of a red-sensitive yellow color-forming layer (first layer) having a spectral sensitivity maximum near 670 nm, a red-sensitive magenta color-forming layer (third layer) having a spectral sensitivity maximum near 740 nm, and an infrared-sensitive cyan color-forming layer (fifth layer) having a spectral sensitivity maximum near 830 nm.

Photographic materials 202 to 208 were prepared in the same manner as photographic material 201, except that the cyan coupler of the fifth layer (infrared-sensitive cyan color forming photosensitive layer) of the photographic material 201 was changed as shown in the following Table.

| Photographic Material | Cyan Coupler used in the 5th layer | | Remarks |
|---|---|---|---|
| | Coupler | Amount used (g/m$^2$) | |
| 201 | ExC | 0.33 | Comparison |
| 202 | ExC-2 | 0.33 | Comparison |
| 203 | ExC-3 | 0.33 | Comparison |
| 204 | C-1 | 0.17 | This Invention |
| 205 | C-3 | 0.17 | This Invention |
| 206 | C-19 | 0.17 | This Invention |
| 207 | C-39 | 0.17 | This Invention |
| 208 | C-52 | 0.17 | This Invention |

The thus prepared photographic materials were exposed to light in the following two ways:

(1) Scanning Exposure

A semiconductor laser AlGaInP (the emitting wavelength: about 670 nm; Type No. TOLD9211, manufactured by Toshiba), a semiconductor laser GaAlAs (the emitting wavelength: about 750 nm; Type No. LTO30MDO, manufactured by Sharp Corporation), and a semiconductor laser GaAlAs (the emitting wavelength: about 830 nm; Type No. LTO15MDO manufactured by Sharp Corporation) were used. The apparatus was constituted such that by a rotating polygon the laser lights could traverse color paper moving in the direction orthogonal to the scanning direction, to carry out successively the exposure of the color paper to the lights. By using this apparatus, the amounts of lights were changed and the relationship D-log E between the density (D) of the photographic material and the amount of the light (E) was determined. The amount of light of the semiconductor laser for exposure was controlled by a combination of a pulse width modulating system, for modulating the amount of light by changing the time of electricity supply to the semiconductor laser, with an intensity modulating system, for modulating the amount of light by changing the amount of electricity supply. The scanning exposure was carried out with the picture element density being 400 dpi, and at that time the average exposure time per picture element was about $10^{-7}$ sec. The temperature of the semiconductor lasers was kept constant by using Peltier devices, so that the amounts of lights might be kept from changing by the temperature.

(2) Plane Exposure

Using a sensitometer (FWH type, manufactured by Fuji Photo Film Co., Ltd.; the color temperature of the light source: 3200 K.) and interference filters of 670 nm, 750 nm, and 830 nm, monochromatic lights were taken out and gradation exposure was given to the photographic material through a gradation wedge for sensitometry. At that time, the exposure to light was carried out such that the amount of exposure per sec of the exposure time was 25,000 CMS.

One of the samples exposed to light was processed in the steps shown in Example 1 with a freshly prepared color developer that was the same as shown in Example 1, to prepare Sample (a), and the other was processed in the same steps as above with the color developer that had been used continuously (running) until the replenishing amount reached twice the volume of the tank, to prepare Sample (b).

The logarithm of the amount of light required to give 1.0 to the cyan density of the infrared-sensitive layer of the obtained Samples (a) and (b) was determined, to find sensitivities Sc (1−(a)) (the sensitivity of the sample obtained by subjecting to the exposure (1) and to the processing (a)), Sc (1−(b)), Sc (2−(a)), and Sc (2−(b)). The differences of the sensitivities:

$$\Delta S1=[Sc\ (1-(b))-Sc\ (1-(a))]$$

and $$\Delta S2=[Sc\ (2-(b))-Sc\ (2-(a))]$$

were used as scales of the change of the sensitivity of the infrared-sensitive layer caused by a change in the processing solution at the time when scanning exposure and plane exposure were carried out.

The obtained results of the samples are shown in Table 3.

TABLE 3

| Photographic Material | Change in Sensitivity of Cyan Color-forming Layer due to Change of Processing Solution: ΔS1 (Scanning Exposure) | ΔS2 (Plane Exposure) | Remarks |
|---|---|---|---|
| 201 | −0.10 | −0.04 | Comparison |
| 202 | −0.12 | −0.05 | Comparison |
| 203 | −0.09 | −0.05 | Comparison |
| 204 | −0.05 | −0.04 | This Invention |
| 205 | −0.04 | −0.03 | This Invention |
| 206 | −0.03 | −0.03 | This Invention |
| 207 | −0.04 | −0.04 | This Invention |
| 208 | −0.05 | −0.04 | This Invention |

Note;
S1 = [Sc(1-(b))-Sc(1-(a))]
S2 = [Sc(2-(b))-Sc(2-(a))]

From the obtained results, it can be understood that by using the present cyan coupler in an infrared-sensitive layer, the change in the sensitivity of the infrared-sensitive layer due to a change in a processing solution becomes small. Further, this effect is more remarkable in scanning exposure, that is, in high-intensity short-period exposure.

EXAMPLE 3

A multilayer photographic material 301 having layer compositions shown below was prepared.

Preparation of Photographic Material 301

A multilayer color print paper having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzene-sulfonate. Coating solutions were prepared as follows:

Preparation of the First Layer Coating Solution

To 19.1 g of yellow coupler (Ex3Y), 4.4 g of image-dye stabilizer (Cpd-31), and 0.7 g of image-dye stabilizer (Cpd-37), 27.2 ml of ethyl acetate and each 4.1 g of solvent (Solv-33) and (Solv-37) were added and dissolved, and the resulting solution was dispersed and emulsified in 185 ml of 10% aqueous gelatin solution containing 8 ml of 10% sodium dodecylbenzenesulfonate solution, thereby prepared emulsified dispersion. Separately silver chlorobromide emulsion A was prepared in the same manner as in Example 1. The above-described emulsified dispersion and this silver chlorobromide emulsion A were mixed together and dissolved to give the composition shown below, thereby preparing the first layer coating solution.

Coating solution for the fifth layer was prepared in the same manner as the coating solution for fifth layer of Example 1.

Coating solutions for the second to fourth, and sixth and seventh layers were also prepared in the same manner as above described. As a gelatin hardener for the respective layers, 1-oxy-3,5-dichloro-s-triazine sodium salt was used.

Further, Cpd-310 and Cpd-311 were added in each layer in such amounts that the respective total amount becomes 25.0 mg/m$^2$ and 50.0 mg/m$^2$.

As spectral sensitizing dyes for each emulsion layer (Dye-A/B), (Dye-C/D), and (Dye-E) which were used in Example 1 were used.

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes used in Example 1 for prevention of irradiation were added.

Composition of Layers

The composition of each layer is shown below. The figures represent coating amount (g/m$^2$). The coating amount of each silver halide emulsion is given in terms of silver.

| | | |
|---|---|---|
| Supporting Base | | |
| | Paper laminated on both sides with polyethylene (a white pigment, $TiO_2$, and a bluish dye, ultramarine, were included in the first layer side of the polyethylene-laminated film) | |
| First layer (Blue-sensitive emulsion layer) | | |
| | Silver chlorobromide emulsion A same as in Example 1 | 0.30 |
| | Gelatin | 1.22 |
| | Yellow coupler (Ex3Y) | 0.82 |
| | Image-dye stabilizer (Cpd-31) | 0.19 |
| | Solvent (Solv-33) | 0.18 |
| | Image-dye stabilizer (Cpd37) | 0.06 |
| Second Layer (Color-mix preventing layer) | | |
| | Gelatin | 0.64 |
| | Color mix inhibitor (Cpd-35) | 0.10 |
| | Solvent (Solv-31) | 0.16 |
| | Solvent (Solv-34) | 0.08 |
| Third Layer (Green-sensitive emulsion layer) | | |
| | Silver chlorobromide emulsion B same as in Example 1 | 0.12 |
| | Gelatin | 1.28 |
| | Magenta coupler (Ex3M) | 0.23 |
| | Image-dye stabilizer (Cpd-32) | 0.03 |
| | Image-dye stabilizer (Cpd-33) | 0.16 |
| | Image-dye stabilizer (Cpd-34) | 0.02 |
| | Image-dye stabilizer (Cpd-39) | 0.02 |
| | Solvent (Solv-32) | 0.40 |
| Fourth Layer (Ultraviolet ray-absorbing layer) | | |
| | Gelatin | 1.41 |
| | Ultraviolet ray absorber (UV-31) | 0.47 |
| | Color-mix inhibitor (Cpd-35) | 0.05 |
| | Solvent (Solv-35) | 0.24 |
| Fifth Layer (Red-sensitive emulsion layer) | | |
| | Silver chlorobromide emulsion C same as Example 1 | 0.23 |
| | Gelatin | 1.04 |
| | Cyan coupler (Ex3C) | 0.32 |
| | Image-dye stabilizer (Cpd-32) | 0.03 |
| | Image-dye stabilizer (Cpd-34) | 0.02 |
| | Image-dye stabilizer (Cpd-36) | 0.18 |
| | Image-dye stabilizer (Cpd-37) | 0.40 |
| | Image-dye stabilizer (Cpd-38) | 0.05 |
| | Solvent (Solv-36) | 0.14 |
| Sixth Layer (Ultraviolet ray-absorbing layer) | | |
| | Gelatin | 0.48 |
| | Ultraviolet ray absorber (UV-31) | 0.16 |
| | Image-dye stabilizer (Cpd-35) | 0.02 |
| | Solvent (Solv-35) | 0.08 |
| Seventh Layer (Protective layer) | | |
| | Gelatin | 1.10 |
| | Acryl-modified copolymer of polyvinyl alcohol (modification degree: 17%) | 0.17 |
| | Liquid paraffin | 0.03 |

Compounds used are as follows:

(Ex3Y) Yellow coupler

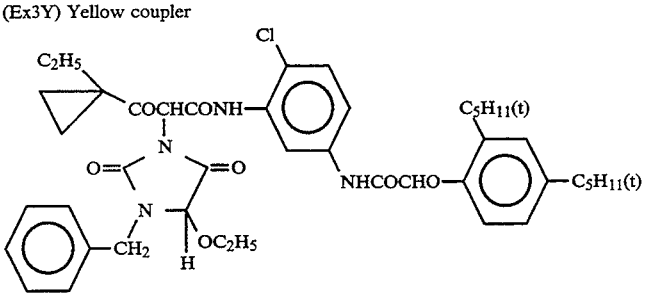

(Ex3M) Magenta coupler

-continued
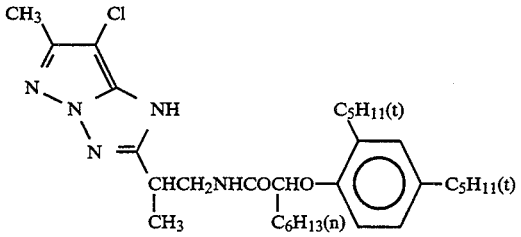
(Ex3C) Cyan coupler
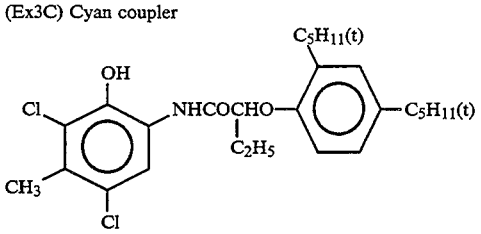
(Cpd-31) Image-dye stabilizer
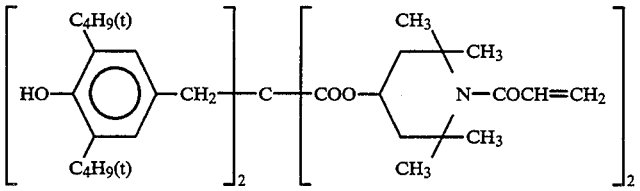
(Cpd-32) Image-dye stabilizer
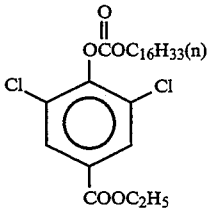
(Cpd-33) Image-dye stabilizer
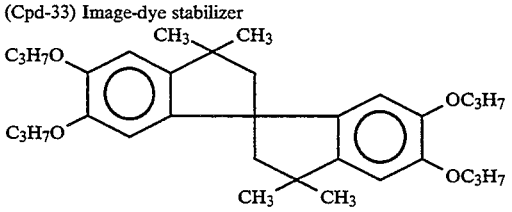
(Cpd-34) Image-dye stabilizer
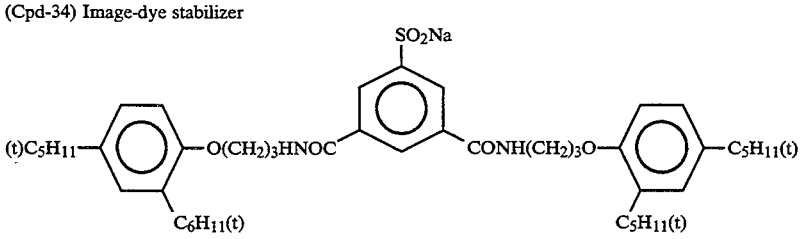
(Cpd-35) Color-mix inhibitor
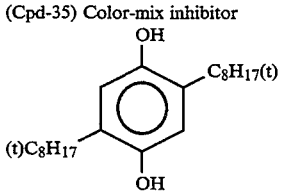
(CPd-36) Image-dye stabilizer
Mixture (2:4:4 in weight ratio) of -continued
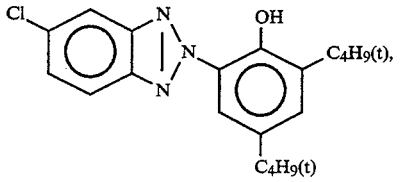
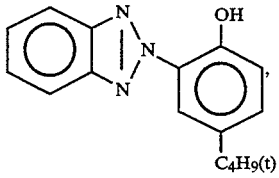
and
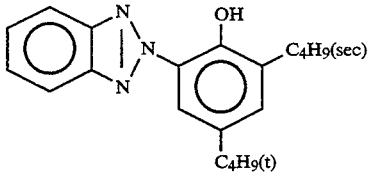
(Cpd-37) Image-dye stabilizer
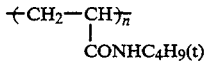
Av. molecular weight: 60,000
(Cpd-38) Image-dye stabilizer
Mixture (1:1 in weight ratio) of
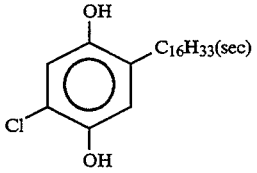
and
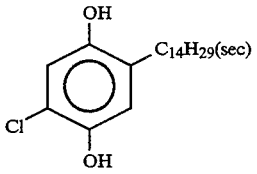
(Cpd-39) Image-dye stabilizer
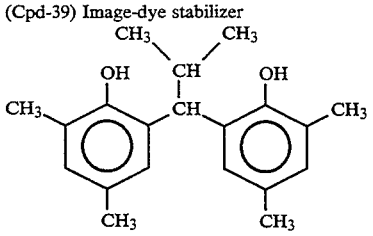
(Cpd-310) Antiseptic
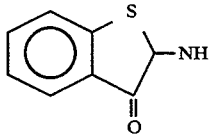
(Cpd-311) Antiseptic -continued
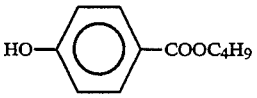
(UV-31) Ultraviolet ray absorber
Mixture (4:2:4 in weight ratio) of (i), (ii), and (iii)
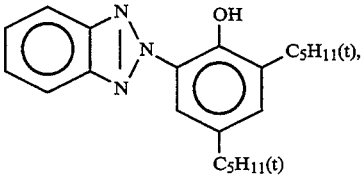
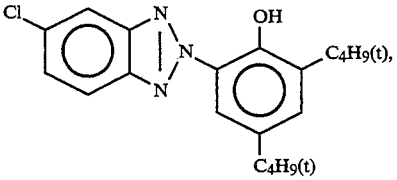
and
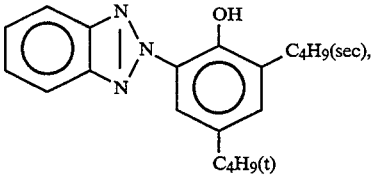
(Solv-31) Solvent
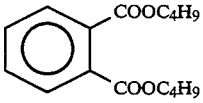
(Solv-32) Solvent
Mixture (1:1 in volume ratio) of
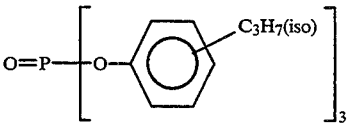
and
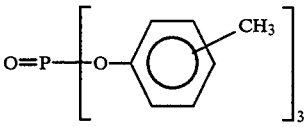
(Solv-33) Solvent
$O{=}P{+}O{-}C_9H_{19}(iso)]_3$
(Solv-34) Solvent
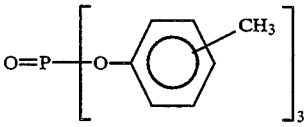
(Solv-35) Solvent
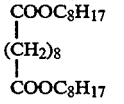

-continued (Solv-36) Solvent
Mxiture (80:20 in weight ratio) of

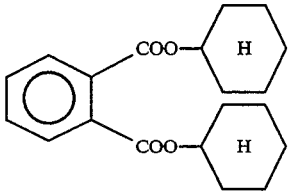

and $C_8H_{17}CHCH^*CH_2)_7COOC_8H_{17}$
$\backslash\ |$
O (Solv-37) Solvent
$C_8H_{17}CHCH(CH_2)_7COOC_8H_{17}$
$\backslash\ |$
O Photographic Materials 302 to 308 were prepared in the same manner as photographic material 301, except that the cyan couplers of the fifth layer was changed as shown in the following Table.

| Photographic Material | Cyan coupler in the 5th layer Coupler | Amount used (g/m$^2$) | Remarks |
|---|---|---|---|
| 301 | Ex3C | 0.33 | Comparison |
| 302 | ExC-2 | 0.33 | Comparison |
| 303 | ExC-3 | 0.33 | Comparison |
| 304 | C-1 | 0.17 | This Invention |
| 305 | C-2 | 0.17 | This Invention |
| 306 | C-19 | 0.17 | This Invention |
| 307 | C-34 | 0.17 | This Invention |
| 308 | C-52 | 0.17 | This Invention |

Thus obtained photographic materials were subjected to the same exposure to light and developing process as in Example 1, and the similar evaluation was conducted. Results are show in Table 4.

TABLE 4

| Photographic Material | Change in Sensitivity of Cyan Color-forming Layer due to Change of Processing Solution: ΔS1 (Scanning Exposure) | ΔS2 (Plane Exposure) | Remarks |
|---|---|---|---|
| 301 | −0.08 | −0.04 | Comparison |
| 302 | −0.09 | −0.04 | Comparison |
| 303 | −0.09 | −0.03 | Comparison |
| 304 | −0.04 | −0.03 | This Invention |
| 305 | −0.04 | −0.03 | This Invention |
| 306 | −0.03 | −0.02 | This Invention |
| 307 | −0.04 | −0.03 | This Invention |
| 308 | −0.03 | −0.03 | This Invention |

Note;
S1 = [Sc(1-(b))-Sc(1-(a))]
S2 = [Sc(2-(b))-Sc(2-(a))]

As is apparent from the results in Table 4, as similar to the results in Example 1, changes in sensitivity of red-sensitive emulsion layer due to change in processing solution are remarkably small by utilizing couplers of the present invention in the red-sensitive layer. Further, this effect is more remarkable in the case of scanning exposure, that is, high-intensity short-period exposure.

EXAMPLE 4

Each of photographic materials prepared in Examples 1 to 3, that is, photographic materials 101 to 108, 201 to 208, and 301 to 308, was exposed to light in the same manner as in respective Examples, and then was processed, by a paper processor, in the steps shown below with a freshly prepared color developer having composition shown below, to prepare Sample (a) and the other was processed in the same steps as above with the color developer that had been used in continuous processing (running test) until the replenishing amount reached twice the tank volume, to prepare Sample (b). With respect to thus-obtained Samples (a) and (b), the same evaluation as Example 1 was conducted. From the results it was confirmed that the change in sensitivity due to change of processing solution became small by using couplers of the present invention, as similar to those of Examples 1 to 3.

| Processing step | Temperature | Time | Replenisher* | Tank Volume |
|---|---|---|---|---|
| Color developing | 35° C. | 20 sec | 60 ml | 2 liter |
| Bleach-fixing | 30–35° C. | 20 sec | 60 ml | 2 liter |
| Rinse (1) | 30–35° C. | 10 sec | — | 1 liter |
| Rinse (2) | 30–35° C. | 10 sec | — | 1 liter |
| Rinse (3) | 30–35° C. | 10 sec | 120 ml | 1 liter |
| Drying | 70–80° C. | 20 sec | | |

Note:
*Replenisher amount per m$^2$ of photographic material.
Rinsing steps were carried out in 3-tanks countercurrent mode from the tank of rinse (3) toward the tank of rinse (1).

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 4.9 g | — |
| Potassium carbonate | 25 g | 37 g |
| 4-Amino-3-methyl-N-ethyl-N-(3-hydroxypropyl)-aniline 2.p-toluenesulfonic acid | 12.8 g | 19.8 g |
| N,N-Bis(carboxymethyl)hydrazine | 5.5 g | 7.0 g |
| Fluorescent whitening agent (WHITEX 4B, | 1.0 g | 2.0 g |

-continued

| | | |
|---|---|---|
| made by Sumitomo Chem. Ind.) | | |
| Water to make | 1000 ml | 1000 ml |
| pH (25° C.) | 10.05 | 10.45 |
| Bleach-fixing solution (Both tank solution and replenisher) | | |
| Water | | 400 ml |
| Ammonium thiosulfate (700 g/l) | | 100 ml |
| Sodium sulfite | | 17 g |
| Iron (III) ammonium ethylenediaminetraacetate | | 55 g |
| Disodium ethylenediaminetetraacetate | | 5 g |
| Ammonium bromide | | 40 g |
| Water to make | | 1000 ml |
| pH (25° C.) | | 6.0 |
| Rinse solution (Both tank solution and replenisher) | | |
| Ion-exchanged water (each ion of calcium and magnesium was 3 ppm or less) | | |

Apparatus shown in FIG. 1 was used in this processing.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming a color image using a silver halide color photographic material having on a support at least three silver halide photosensitive layers that are different in color sensitivity and that contain respectively a coupler capable of forming a color of yellow, magenta, or cyan, comprising, in at least one photosensitive layer containing a cyan color-forming coupler of the said silver halide color photographic material, at least one cyan dye-forming coupler represented by the following formula (I) or (II), wherein the photosensitive layer containing the at least one cyan dye-forming coupler represented by formula (I) or (II) has a spectral sensitivity maximum by 560 nm or more, and said photographic material is exposed to a laser light by a scanning exposure system wherein an exposure time per picture element is less than $10^{-4}$ sec, and then is subjected to color development processing in a color developing solution comprising a color developing agent:

formula(I)

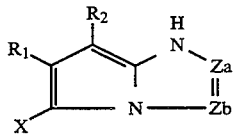

formula(II)

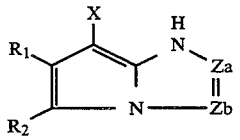

wherein Za and Zb each represent —C($R_3$)= or —N=, provided that one of Za and Zb represents —N= and the other represents —C($R_3$)=, $R_1$ and $R_2$ each represent an electron-attracting group, wherein the Hammett substituent constant $\sigma_p$ value is 0.20 or over, with the sum of the $\sigma_p$ values of $R_1$ and $R_2$ being 0.65 or over, $R_3$ represents a hydrogen atom, a halogen atom, an alkyl group, an aryl group, a heterocyclic group, a cyano group, a hydrozyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group, and X represents a hydrogen atom or a group capable of being released upon coupling reaction with the oxidized product of an aromatic primary amine color-developing agent, provided that $R_1$, $R_2$, $R_3$, or X may be a divalent group, to form a dimer or higher polymer, or to bond to a polymer chain to form a homopolymer or copolymer.

2. The method for forming a color image as claimed in claim 1, wherein silver halide emulsion grains having 95 mol % or more of silver chloride content are contained in at least one photosensitive layer containing said cyan color-forming coupler.

3. The method of forming a color image as claimed in claim 1, wherein $R_2$ in formula (I) is a branched alkoxycarbonyl group or an alkoxycarbonyl group having an electron-attracting group.

4. The method for forming a color image as claimed in claim 1, wherein all of the spectral sensitivity maxima of three silver halide photosensitive layers that are different in color sensitivity are 650 nm or over, respectively, and a semiconductor laser is used as a scanning exposure light source.

5. The method for forming a color image as claimed in claim 1, wherein the processing time of color developing is within 25 sec, and the total processing time from the said color developing process to drying process both inclusive is within 120 sec.

6. The method for forming a color image as claimed in claim 1, wherein the cyan dye-forming coupler is represented by the following formula (I-a), (I-b), (II-a), or (II-b):

formula (I-a)

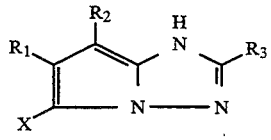

formula (II-a)

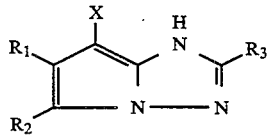

formula (I-b)

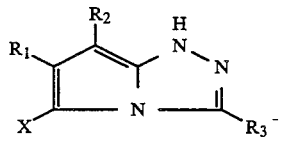

-continued formula (II-b)

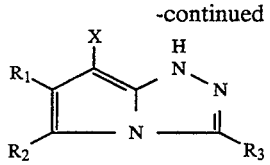

wherein $R_1$, $R_2$, $R_3$, and X each have the same meanings as those of $R_1$, $R_2$, $R_3$, and X in formula (I) or (II).

7. The method for forming a color image as claimed in claim 1, wherein the Hammett substituent constant $\sigma_p$ of the electron-attracting group represented by $R_1$ or $R_2$ in formula (I) or (II) is 0.30 to 1.0.

8. The method for forming a color image as claimed in claim 1, wherein the sum of the $\sigma_p$ values of $R_1$ and $R_2$ in formula (I) or (II) is 0.70 to 1.80.

9. The method for forming a color image as claimed in claim 1, wherein the cyan dye-forming coupler is represented by formula (I).

10. The method for forming a color image as claimed in claim 1, wherein the cyan dye-forming coupler represented by formula (I) or (II) is added to the silver halide color photographic material in an amount of $10^{-3}$ to 1 mol per mol of the silver halide.

11. The method for forming a color image as claimed in claim 1, wherein the exposure time per picture element is $10^{-4}$ to $10^{-10}$ sec.

12. The method for forming a color image as claimed in claim 1, wherein the exposure time per picture element is $10^{-6}$ to $10^{-10}$ sec.

13. The method for forming a color image as claimed in claim 1, wherein the yellow dye-forming coupler represented by the following formula (Y) is used in the yellow color-forming coupler-containing photosensitive layer of the silver halide color photographic material:

formula (Y)

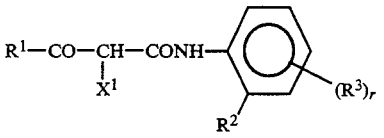

wherein $R^1$ represents a tertiary alkyl group or an aryl group, $R^2$ represents a hydrogen atom, a halogen atom, an alkoxy group, an aryloxy group, an alkyl group, or a dialkylamino group, $R^3$ represents a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, or an arylsulfonyloxy group, $X^1$ represents a hydrogen atom or a coupling-off group, and r is an integer of 0 to 4, and when r is an integer of 2 to 4, the $R^3$ groups may be the same or different.

14. The method for forming a color image as claimed in claim 1, wherein silver chloride grains having a silver chloride content of 95 mol % or more and containing 0.01 to 3 mol % of silver iodide on the surface of the emulsion grains are used in photosensitive silver halide emulsion layers of the silver halide color photographic material.

15. The method for forming a color image as claimed in claim 1, wherein silver halide grains comprising silver chloride or silver bromochloride substantially free from silver iodide are used in photosensitive silver halide emulsion layers of the silver halide color photographic material.

16. The method for forming a color image as claimed in claim 1, wherein silver halide grains containing cubic, tetradecahedral or octahedral grains in an amount of 50% or more are used in a photosensitive silver halide emulsion layer of the silver halide color photographic material.

17. The method for forming a color image as claimed in claim 1, wherein: (a) a gas laser, (b) a light-emitting diode, (c) a semiconductor laser, or (d) a secondary harmonics generating apparatus comprising a combination of a nonlinear optical element with a semiconductor or a solid state laser, are used in the scanning exposure system utilizing a monochromatic high-intensity light.

18. The method for forming a color image as claimed in claim 1, wherein the at least one cyan dye forming coupler is a cyan dye forming coupler represented by formula (I); wherein $R_1$ in formula (I) is selected from the group consisting of an aryloxycarbonyl group, a cyano group, an arylsulfonyl group and a halogenated alkyl group; and $R_2$ in formula (I) is an aryloxycarbonyl group or an alkoxycarbonyl group.

19. The method for forming a color image as claimed in claim 1, wherein $R_1$ in formula (I) is a cyano group.

20. The method of forming a color image as claimed in claim 6, wherein the cyan dye-forming coupler is represented by formula (I-a).

* * * * *

UNITED STATES PATENT AND TRADEMARK OFFICE

CERTIFICATE OF CORRECTION

PATENT NO. : 5,445,924

DATED : August 29, 1995

INVENTOR(S) : Kiyoshi Kawai

It is certified that error appears in the above-indentified patent and that said Letters Patent is hereby corrected as shown below:

On the title page, item [56], insert

U.S. PATENT DOCUMENTS please add the following:

5,154,995 10/91 Kawai

FOREIGN PATENT DOCUMENTS please add the following:

0491197 6/1992 European Pat. Off.

OTHER PUBLICATIONS

Patent Abstracts of Japan, No. JPA 3 015 049,

January 23, 1991--

Signed and Sealed this

Nineteenth Day of March, 1996

Bruce Lehman

*Attest:*

BRUCE LEHMAN

*Attesting Officer*

*Commissioner of Patents and Trademarks*